US011939707B2

(12) United States Patent
Martin et al.

(10) Patent No.: US 11,939,707 B2
(45) Date of Patent: Mar. 26, 2024

(54) SYSTEMS AND METHODS FOR CREATING TOPOGRAPHICAL WOVEN FABRIC

(71) Applicant: unspun, inc., San Francisco, CA (US)

(72) Inventors: Kevin Peter Martin, San Francisco, CA (US); Elizabeth Faith Esponnette, San Francisco, CA (US); Walden Hoi Ming Lam, San Francisco, CA (US); Sarah Marie Lafasto, San Francisco, CA (US); Benjamin Wagner Cloud, San Francisco, CA (US); Brian Joseph Gormley, San Francisco, CA (US); Chase Michael Goodman, San Francisco, CA (US); Simeon Dimitrov Kostadinov, San Francisco, CA (US); Tyler Nathaniel Perkins, San Francisco, CA (US); Nicholas Anthony Bollen, San Francisco, CA (US)

(73) Assignee: UNSPUN, INC., San Francisco, CA (US)

( * ) Notice: Subject to any disclaimer, the term of this patent is extended or adjusted under 35 U.S.C. 154(b) by 0 days.

(21) Appl. No.: 16/655,112

(22) Filed: Oct. 16, 2019

(65) Prior Publication Data

US 2020/0048799 A1 Feb. 13, 2020

Related U.S. Application Data

(63) Continuation of application No. PCT/US2018/030000, filed on Apr. 27, 2018.
(Continued)

(51) Int. Cl.
*D03C 3/12* (2006.01)
*D03C 13/00* (2006.01)
(Continued)

(52) U.S. Cl.
CPC ..... *D03D 25/005* (2013.01); *D03C 13/02* (2013.01); *D03D 3/08* (2013.01); *D03D 41/004* (2013.01);
(Continued)

(58) Field of Classification Search
CPC ..... D03D 25/005; D03D 3/08; D03D 41/004; D03D 49/12; D03D 51/02; D03D 49/16;
(Continued)

(56) References Cited

U.S. PATENT DOCUMENTS 2,759,494 A * 8/1956 Honegger ..... D03D 51/02 139/1 R
2,998,030 A * 8/1961 Koppelman ..... D03D 49/20 139/387 R
(Continued)

FOREIGN PATENT DOCUMENTS

CN 1183123 A 5/1998
DE 3915085 5/1998
(Continued)

OTHER PUBLICATIONS

EP18792118.4 Extended European Search Report dated Nov. 26, 2020.
(Continued)

*Primary Examiner* — Robert H Muromoto, Jr.
(74) *Attorney, Agent, or Firm* — Diederiks & Whitelaw, PLC.

(57) ABSTRACT

Provided are systems and methods for producing seamless woven materials that are variable in each of their 3 dimensions. The systems and methods generally operate by altering heddle positions independently to impart three dimensional structure to a woven fabric. Weft yarn is woven into a set of warp yarns that have been individually raised or
(Continued)

lowered along a particular cross section, essentially locking the weave into an intended 3 dimensional form.

22 Claims, 26 Drawing Sheets

Related U.S. Application Data

(60) Provisional application No. 62/491,266, filed on Apr. 28, 2017.

(51) Int. Cl.

| | |
|---|---|
| ***D03D 3/08*** | (2006.01) |
| ***D03D 25/00*** | (2006.01) |
| ***D03D 41/00*** | (2006.01) |
| ***D03D 49/12*** | (2006.01) |
| ***D03D 51/02*** | (2006.01) |
| *D03C 3/20* | (2006.01) |
| *D03D 13/00* | (2006.01) |

(52) U.S. Cl.
CPC ..... *D03D 49/12* (2013.01); *D03D 51/02* (2013.01); *D03C 3/205* (2013.01)

(58) Field of Classification Search
CPC ..... D03D 1/00; D03D 3/00; D03D 41/00; D03D 51/005; D03D 49/04; D03D 49/14; D03D 51/28; D03D 51/46; D03D 2700/265; D03D 47/267; D03C 13/02; D03C 3/205; D03C 13/00; D03C 3/20; D03C 5/00; D03C 1/144; D03C 1/146; D03C 11/00; D03C 13/025; D03C 1/148; D03C 3/26; D03C 1/12; D03C 1/16; D03C 5/02; D03C 5/06; D02H 1/00; Y10S 139/01
See application file for complete search history.

(56) References Cited

U.S. PATENT DOCUMENTS 3,405,740 A * 10/1968 Juillard ..... D03D 51/02 139/1 E
3,557,842 A * 1/1971 Porter ..... D03C 5/06 139/55.1
3,807,460 A * 4/1974 Alexandr ..... D03C 1/12 139/76
3,824,774 A * 7/1974 Kobayashi ..... D03D 41/00 57/24
3,831,638 A * 8/1974 Selivanov ..... D03D 47/267 139/436
4,147,822 A * 4/1979 Kallmeyer ..... D03D 3/00 139/16
4,196,756 A * 4/1980 Griffith ..... D03D 47/263 139/436
4,235,262 A * 11/1980 Ushiro ..... D03D 47/38 139/452
4,353,396 A * 10/1982 Suzuki ..... D03C 7/04 139/54
4,393,902 A * 7/1983 Brock ..... D03C 1/144 139/76
4,429,722 A * 2/1984 Herzog ..... D03C 7/005 139/48
4,478,254 A * 10/1984 Beaudoux ..... D03C 1/16 139/1 E
4,518,020 A * 5/1985 Speich ..... F16H 35/02 139/55.1
4,651,784 A * 3/1987 Rambousek ..... D03C 13/00 139/57
4,903,737 A * 2/1990 Bottger ..... E03F 5/04 139/188 R
5,069,256 A * 12/1991 Goodman, Jr. ..... D03C 13/00 139/83
5,070,913 A * 12/1991 Palmer ..... D03C 3/205 139/319
5,080,141 A * 1/1992 Bottger ..... E03F 5/04 139/383 R
5,085,252 A * 2/1992 Mohamed ..... D03D 41/004 139/22
5,141,030 A * 8/1992 Arakawa ..... D03J 1/00 139/35
5,279,334 A * 1/1994 Takegawa ..... D03D 47/278 139/1 C
5,348,053 A * 9/1994 Oertli ..... D03C 9/00 139/57
5,653,268 A * 8/1997 Burkert ..... D03C 5/02 139/76
5,775,380 A * 7/1998 Roelstraete ..... D03J 1/14 139/1 R
6,000,442 A 12/1999 Busgen
6,050,305 A * 4/2000 Braun ..... D03C 3/20 139/455
6,058,983 A * 5/2000 Bourgeaux ..... D03C 3/20 139/455
6,216,750 B1 * 4/2001 Braun ..... D03C 3/20 139/455
6,269,842 B1 * 8/2001 Chuang ..... D03D 49/44 139/134
6,357,486 B2 * 3/2002 Braun ..... D03C 3/205 139/455
7,007,721 B2 * 3/2006 Bassi ..... D03C 3/20 139/59
7,178,558 B2 * 2/2007 Nayfeh ..... D03D 33/00 139/1 E
7,320,343 B2 * 1/2008 Speich ..... D03C 3/10 139/110
7,341,077 B2 * 3/2008 Sampers ..... D03C 1/146 139/1 E
7,721,768 B2 * 5/2010 Iltis ..... D03C 3/20 139/21
7,894,928 B2 * 2/2011 Puget ..... D03C 3/20 700/140
9,359,698 B2 * 6/2016 Shimazaki ..... D03C 7/00
10,355,554 B2 * 7/2019 Parmar ..... F16H 25/20
10,392,731 B2 * 8/2019 Esponnette ..... D03C 9/0633
2001/0039975 A1 * 11/2001 Braun ..... D03C 3/205 139/59
2004/0261881 A1 * 12/2004 Svensson ..... D03D 47/275 139/55.1
2005/0103394 A1 * 5/2005 Bassi ..... D03C 13/00 139/59
2006/0169345 A1 * 8/2006 Speich ..... D03D 51/30 139/55.1
2006/0207674 A1 * 9/2006 Sampers ..... D03D 51/005 139/1 E
2006/0249217 A1 * 11/2006 Nayfeh ..... D03D 41/00 139/11
2007/0293976 A1 * 12/2007 Puget ..... D03C 3/205 700/140
2008/0236700 A1 * 10/2008 Iltis ..... D03C 3/12 139/397
2008/0300602 A1 12/2008 Schmitt et al.
2009/0126823 A1 5/2009 Yengkhom
2011/0265905 A1 11/2011 Kuhl et al.
2011/0290368 A1 * 12/2011 Lehmann ..... D03C 1/146 139/1 E
2012/0165918 A1 6/2012 Du
2013/0312867 A1 11/2013 Champion et al.
2015/0059914 A1 * 3/2015 Shimazaki ..... D03C 11/00 139/50
2016/0281277 A1 * 9/2016 Esponnette ..... D03D 41/00
2017/0067190 A1 3/2017 Miyamae et al.
2020/0048799 A1 * 2/2020 Martin ..... D02H 1/00

FOREIGN PATENT DOCUMENTS

JP H02210038 8/1990
JP 2000-119928 4/2000

(56) References Cited

FOREIGN PATENT DOCUMENTS

| | | |
|---|---|---|
| JP | 2004-308064 | 11/2003 |
| JP | 2013-241691 | 12/2013 |
| WO | WO-2018201075 A1 | 11/2018 |

OTHER PUBLICATIONS

PCT/US2018/030000 International Search Report and Written Opinion dated Aug. 21, 2018.

* cited by examiner

SYSTEMS AND METHODS FOR CREATING TOPOGRAPHICAL WOVEN FABRIC

CROSS-REFERENCE TO RELATED APPLICATION

This application is a continuation application of International Application No. PCT/US2018/030000, filed on Apr. 27, 2018, which application claims priority to U.S. Provisional Patent Application No. 62/491,266, filed Apr. 28, 2017, which applications are incorporated herein by reference in their entirety for all purposes.

STATEMENT AS TO FEDERALLY SPONSORED RESEARCH

Aspects of the present disclosure may have been made with the support of the United States government under Contract number 1721773 by the National Science Foundation. The government may have certain rights in the invention(s) of the present disclosure.

BACKGROUND

Prior methods of creating curvature in woven materials generally comprise weaving flat fabric (i.e., fabric having variation in at most two dimensions), cutting the flat fabric into pieces, and then stitching these pieces together, thereby imparting a three-dimensional structure to the woven article through the cutting and stitching process. Such methods may be used to build complicated geometry in clothing, but have a number of downsides or limitations. For instance, the amount of labor involved tends to increase with complexity of the three-dimensional geometry, making existing methods less efficient. Also, clothing with complex geometry tends to require a greater number of seams, and the seams created by the cutting and stitching process can be detrimental to structural performance. Moreover, cutting and stitching of flat fabric may generate a substantial amount of waste in the manufacture of woven products. Within the apparel industry alone, it has been estimated that at least 15% of flat woven fabric is discarded during the cutting operation. Thus, there is a need for systems and methods that can efficiently manufacture irregularly shaped woven fabrics with topographical three-dimensional structure having improved structural performance, and with reduced material wastage.

SUMMARY

Disclosed herein are systems and methods for manufacturing irregularly shaped woven fabrics with topographical three-dimensional structure. The systems and methods described herein may provide a variety of benefits compared to prior systems and methods of weaving, which generally comprise weaving flat fabric, cutting the flat fabric into pieces, and stitching these pieces together. For instance, the systems and methods described herein may reduce the number of seams or discontinuities (and therefore structural weaknesses) in a woven material, reduce the generation of waste from the process of manufacturing a woven material, impart better resistance against the elements (such as wind, rain, cold, or sun) to a woven material due to the reduced number of seams or discontinuities, improve the comfort or fit of a woven material, or allow for customization of fit of a woven product to a specific user of the woven material.

The systems and methods described herein generally operate by altering heddle positions independently to impart three dimensional structure on a woven fabric. Weft yarn may be woven into a set of warp yarns, each of the warp yarns having been individually raised or lowered to form a particular local topography, essentially locking the weave into an intended three-dimensional form. This may be accomplished by not only shedding heddles opposite of neighboring heddles, but also by varying heddle position within a shedding group. The systems and methods described herein may be used to produce textile products, such as garments, personal protective equipment, or outdoor goods.

In a first aspect, an industrial seamless woven material may be variable in each of its 3 dimensions. In some embodiments, the woven material may comprise a complete product. The woven material may comprise a partially finished product. The partially finished product may form a portion of a complete product. The woven material may comprise an article of clothing. The article of clothing may be selected from the group consisting of: a shirt, a shirt arm, a jacket, a jacket arm, a vest, a bulletproof vest, a pair of pants, a pant leg, a pair of shorts, a shoe, a sock, an undergarment, a pair of panties, a pair of boxers, a pair of briefs, a pair of boxer briefs, a bra, a sports bra, a headband, a hat, a helmet, a bulletproof helmet, a scarf, a leg brace, a knee brace, an ankle brace, an arm brace, a wrist brace, a shoulder brace, a back brace, a neck brace, a suit, a tie, a dress, a skirt, a poncho, a glove, a backpack, and a snowsuit. The woven material may comprise a recreational product. The recreational product may be selected from the group consisting of: a canoe, a kayak, a bicycle, a boat, a ski, a ski pole, a hiking pole, a hammock, a tent, a sleeping bag, a parachute, a net, a snowboard, a wakeboard, a skateboard, a tennis racquet, a table tennis racquet, a badminton racquet, a baseball bat, a baseball glove, a bow, an arrow, a cart, a case, a golf club, hunting equipment, a fishing rod, a cart, a case, a door, and a home installation. The woven material may comprise a biomedical device. The biomedical device may be selected from the group consisting of: a stent, a prosthetic, a crutch, a wheelchair, a cochlear implant, a suture, a vascular graft, a spinal repair, a tendon replacement, a ligament replacement, a containment sleeve, and a heart valve. The woven material may comprise a product selected from the group consisting of: a satellite, a rocket, an aircraft, a car, housing, and a wind generator blade. The woven material may comprise a material selected from the group consisting of: cotton, polyester, nylon, wool, silk, hemp, ramie, asbestos, coir, pina, sisal, jute, kapok, rayon, viscose, lyocell, linen, flax, acetate, triacetate, spandex, modal, polypropylene, acrylic, modacrylic, aramid, carbon fiber, and fiberglass. The woven material may comprise an average thread density of at least 5, 10, 20, 30, 40, 50, 100, 200, 300, 400, or 500 ends per inch. The woven material may comprise only warp threads and weft threads. The warp threads and the weft threads may be interwoven at an angle of approximately 90 degrees. The woven material may not comprise a knit material. The woven material may not comprise a non-woven material. The first aspect may be optionally combined with any other aspect described herein, such as any 1, 2, 3, 4, 5, 6, 7, 8, or 9 of the second, third, fourth, fifth, sixth, seventh, eighth, ninth, or tenth aspects described herein.

In a second aspect, an actuator system configured to be used in combination with a loom may comprise: (a) a plurality of motors; and (b) a plurality of couplings coupled to the plurality of motors, wherein the plurality of couplings are arranged in a configuration that allows one or more heddles of the loom to be individually controlled and cactuated continuously between a plurality of positions. In some embodiments, each motor may be mechanically coupled to one coupling. Each motor may be coupled to one heddle. Each coupling may reduce an angular velocity imparted to one or more coupled motors, the angular velocity associated with one or more torques due to a gravitational force or a spring force imparted on one or more heddles. Each coupling may comprise a gear reduction component and a pulley system. The pulley system may be threaded or non-threaded. The gear reduction component may be disposed between a motor and the pulley component. The gear reduction component may comprise at least two gears of different pitch diameters or different numbers of teeth. The gear reduction component may reduce a torque-induced turning of a motor. The gear reduction component may comprise a 10:1, 20:1, 50:1, or 100:1 gear reduction ratio. The couplings may allow the motors to be actuated in a controlled manner during an operation of the heddles. The configuration of the plurality of couplings may enable power consumption to be reduced by obviating a need to provide a continuous torque to the one or more heddles during one or more passes of a weft thread across the loom. The system may be configured to draw an electrical power of at most 1 Watt (W), 2 W, or 5 W for one or more of the motors. Each motor may be selected from the group consisting of: brushed direct current (DC) motors, brushless DC motors, servo motors, and stepper motors. Each motor may be configured to move each heddle along one or more axes of a heddle plane of the loom. The system may further comprise a plurality of electronic controllers configured to output electrical signals to the plurality of motors for controlling motion of the motors to effect changes in position of the one or more of the heddles. The plurality of positions may comprise two or more discrete positions along a longitudinal axis of the heddle plane. The plurality of positions may comprise at least three discrete positions along a longitudinal axis of the heddle plane. A distance between two adjacently spaced discrete positions may be at least about 0.01 mm, 0.02 mm, 0.05 mm, 0.1 mm, 0.2 mm, 0.5 mm, 1 mm, 2 mm, 5 mm, or 10 mm. A distance between two adjacently spaced discrete positions may range from about 0.01 mm to about 10 mm. The second aspect may be optionally combined with any other aspect described herein, such as any 1, 2, 3, 4, 5, 6, 7, 8, or 9 of the first, third, fourth, fifth, sixth, seventh, eighth, ninth, or tenth aspects described herein.

In a third aspect, an actuator system configured to be used in combination with a loom may comprise a plurality of electronic actuation modules operably coupled to one another, wherein one or more of the modules are independently replaceable without affecting operation of the remaining modules or without requiring disassembly of one or more of the remaining modules. In some embodiments, one or more of the modules may be configured to be replaceable prior to or during an operation of the loom. Each module may comprise: (a) one or more motors; (b) one or more couplings mechanically coupled to the one or more motors and one or more heddles of the loom; or (c) one or more electronic controllers configured to output electrical signals to the one or more motors controlling motion of the motors to individually effect changes in position of each of the heddles. Each module may comprise: (a) a plurality of motors; (b) a plurality of couplings, each coupling mechanically coupled to one motor and one heddle; and (c) a plurality of electronic controllers, each electronic controller configured to output an electrical signal to one motor, the electrical signal controlling a motion of the motor, the motion of the motor controlling a position of the heddle. The third aspect may be optionally combined with any other aspect described herein, such as any 1, 2, 3, 4, 5, 6, 7, 8, or 9 of the first, second, fourth, fifth, sixth, seventh, eighth, ninth, or tenth aspects described herein.

In a fourth aspect, an actuator system configured to be used in combination with a loom may comprise: (a) a plurality of actuation modules each comprising: (i) one or more motors; and (ii) one or more couplings mechanically coupled to the one or more motors and one or more heddles of the loom; and (b) one or more electronic controllers configured to output electrical signals to the one or more motors for controlling motion of the motors to individually effect changes in position of each of the heddles; wherein the one or more electronic controllers are positioned in proximity to the one or more actuation modules. In some embodiments, the one or more electronic controllers may be positioned above, below, in front of, or behind the one or more modules. The one or more electronic controllers may be located within a distance no greater than a height of the loom from the one or more modules. The one or more electronic controllers may be detachably coupled to the one or more modules. The one or more electronic controllers may be affixed to the one or more modules. The fourth aspect may be optionally combined with any other aspect described herein, such as any 1, 2, 3, 4, 5, 6, 7, 8, or 9 of the first, second, third, fifth, sixth, seventh, eighth, ninth, or tenth aspects described herein.

In a fifth aspect, a heddle system to be used in combination with a loom may comprise a plurality of heddles each individually controllable and configured to move continuously between a plurality of positions along one or more axes. In some embodiments, the one or more axes may be located along a heddle plane of the loom. Each heddle may be configured to individually control a position of a warp string. Individual movement of each heddle between the plurality of positions may define a curved, curvilinear, or non-linear profile of a corresponding warp string along the heddle plane of the loom. The curved, curvilinear, or non-linear profile of the plurality of warp strings may enable 3D variations in local geometry of a woven material produced by the loom. The curved, curvilinear, or non-linear profile may have a symmetrical shape. The curved, curvilinear, or non-linear profile may have a non-symmetrical or irregular shape. The woven material comprising the 3D variations in local geometry may be produced by (1) passing a weft string under or above the curve of warp strings and (2) beating the weft string into a tight interwoven mesh with the plurality of warp strings. The fifth aspect may be optionally combined with any other aspect described herein, such as any 1, 2, 3, 4, 5, 6, 7, 8, or 9 of the first, second, third, fourth, sixth, seventh, eighth, ninth, or tenth aspects described herein.

In a sixth aspect, a loom may be configured to weave an industrial seamless woven material variable in each of its 3 dimensions. The sixth aspect may be optionally combined with any other aspect described herein, such as any 1, 2, 3, 4, 5, 6, 7, 8, or 9 of the first, second, third, fourth, fifth, seventh, eighth, ninth, or tenth aspects described herein.

In a seventh aspect, a loom may be configured to weave a complete woven material, the loom having an overall footprint of at most 20 $m^3$, 10 $m^3$, 5 $m^3$, 2 $m^3$, or 1 $m^3$. The seventh aspect may be optionally combined with any other aspect described herein, such as any 1, 2, 3, 4, 5, 6, 7, 8, or 9 of the first, second, third, fourth, fifth, sixth, eighth, ninth, or tenth aspects described herein.

In an eighth aspect, a loom may be configured to weave a complete woven material, the loom having a maximum linear dimension of at most 5 m, 2 m, or 1 m. The eighth aspect may be optionally combined with any other aspect described herein, such as any 1, 2, 3, 4, 5, 6, 7, 8, or 9 of the first, second, third, fourth, fifth, sixth, seventh, ninth, or tenth aspects described herein.

In a ninth aspect, a loom may comprise a plurality of individually controllable heddles, the loom configured to weave fabric along a two-dimensional (2D) variable heddle plane to produce an article of clothing, wherein the loom is configured to weave a three-dimensional (3D) pattern of fabric without requiring cutting or stitching of 2D patterns of fabric to produce the article of clothing. In some embodiments, the weaving of the fabric may comprise controlling each heddle to individually raise or lower each warp thread of a plurality of warp threads on the 2D variable heddle plane, and weaving a weft thread above, below, or through the plurality of warp threads to lock the fabric into a desired 3D form. The plurality of heddles may be individually configured to move continuously between a plurality of positions along an axis of a heddle plane. Each heddle may be configured to move independently of the other heddles. The loom may further comprise an actuation system configured to individually move each heddle. The actuation system may comprise a plurality of motors. Two or more of the heddles may be configured to move relative to one another, and the relative positions between the two or more heddles may be controllable to define local warp tangent angles of the warp threads that moved by the heddles. The weaving of the fabric along the 2D heddle plane may comprise control of the local warp tangent angles to produce the article of clothing having a desired 3D form. The ninth aspect may be optionally combined with any other aspect described herein, such as any 1, 2, 3, 4, 5, 6, 7, 8, or 9 of the first, second, third, fourth, fifth, sixth, seventh, eighth, or tenth aspects described herein.

In a tenth aspect, a method for producing a product that is variable in each of its 3 dimensions may comprise: (a) providing a loom comprising a plurality of individually controllable heddles; (b) controlling each heddle to individually raise a lower each of a plurality of warp threads; and (c) weaving a weft thread above, below, or through the plurality of warp threads in a transverse manners across the heddle to lock the fabric into a desired 3d form, thereby producing the product. In some embodiments, the method may further comprise controlling movement of two or more of the heddles relative to one another to define local warp tangent angles of the warp threads that are moved by the two or more heddles. The tenth aspect may be optionally combined with any other aspect described herein, such as any 1, 2, 3, 4, 5, 6, 7, 8, or 9 of the first, second, third, fourth, fifth, sixth, seventh, eighth, or ninth aspects described herein.

Additional aspects and advantages of the present disclosure will become readily apparent to those skilled in this art from the following detailed description, wherein illustrative embodiments of the present disclosure are shown and described. As will be realized, the present disclosure is capable of other and different embodiments, and its several details are capable of modifications in various obvious respects, all without departing from the disclosure. For example, various aspects of the disclosure may be applied to any other types of systems and methods for weaving materials to form three dimensional structures. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

BRIEF DESCRIPTION OF THE DRAWINGS

The novel features of the disclosure are set forth with particularity in the appended claims. A better understanding of the features and advantages of the present disclosure will be obtained by reference to the following detailed description that sets forth illustrative embodiments, in which the principles of the invention are utilized, and the accompanying drawings ("Figure" or "FIG." as used herein), of which:

DETAILED DESCRIPTION

Reference will now be made in detail to exemplary embodiments of the disclosure, examples of which are illustrated in the accompanying drawings. Wherever possible, the same reference numbers will be used throughout the drawings and disclosure to refer to the same or like parts.

Described herein are systems and methods for producing seamless woven materials that are variable in each of their 3 dimensions. The systems and methods generally operate by altering heddle positions independently to impart three dimensional structure to a woven fabric. Weft yarn is woven into a set of warp yarns that have been individually raised or lowered along a particular cross section, essentially locking the weave into an intended 3 dimensional form.

As used herein, the terms "string", "thread", and "yarn" are used interchangeably.

As used herein, the terms "warp string" and "weft string" refer to the two basic components used to turn string into a woven article. The term "warp string" refers to a lengthwise or longitudinal string that is held stationary in tension on a loom during a pass of a "weft string" along a direction substantially transverse to the direction along which tension is placed on the warp string. The term "weft string" refers to a string that is woven above and under the warp strings that comprise the woven article, such that that warp and weft string are held together with a length of the warp threads being substantially perpendicular to a length of the weft threads.

Figure 1A:
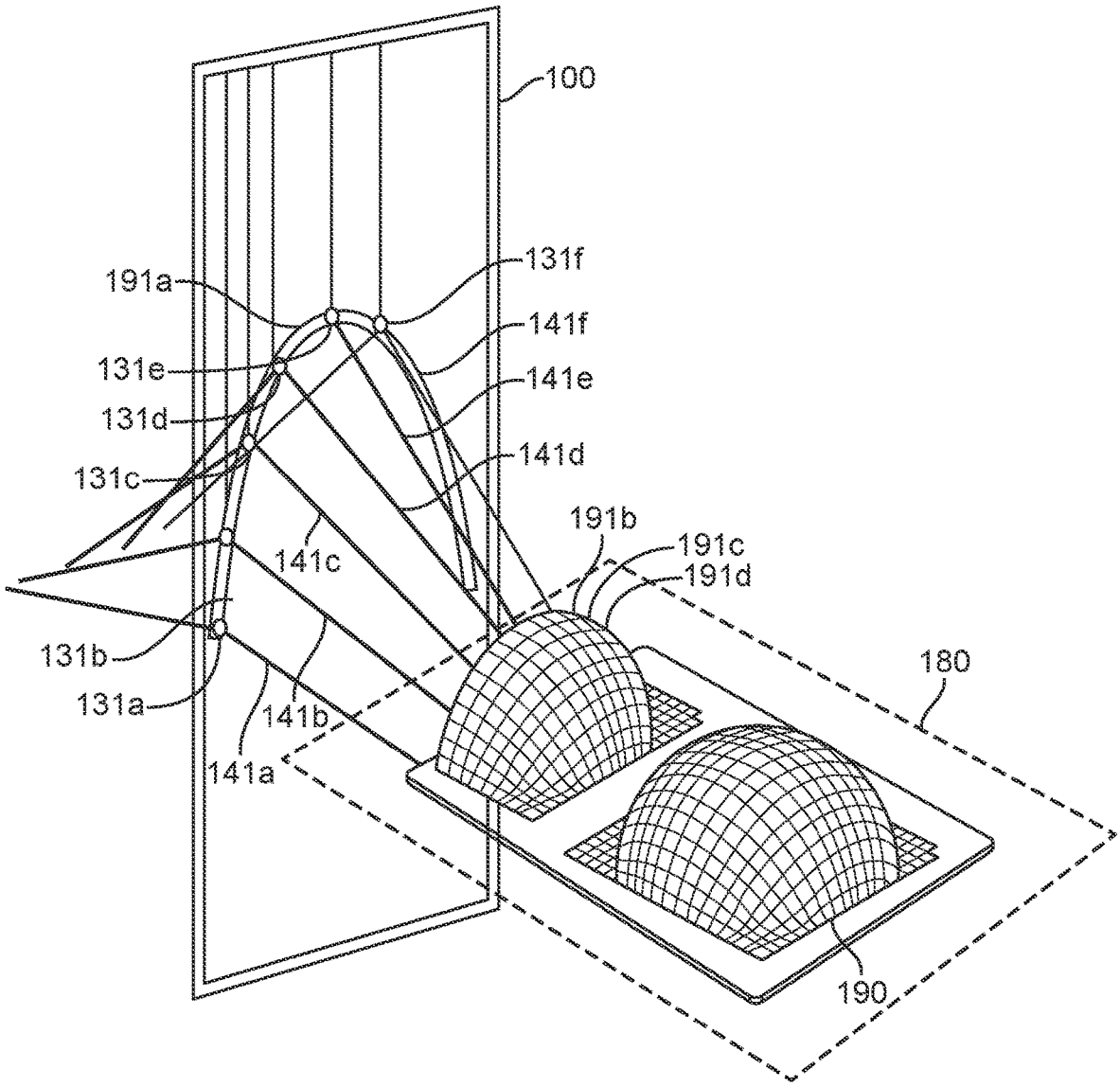
FIG. 1A shows an illustration of a loom configured to weave a seamless woven material that is variable in each of its 3 dimensions, in accordance with some embodiments.

FIG. 1A shows a loom 100 configured to weave a seamless woven material 190 that is variable in each of its 3 dimensions. The loom may be configured to weave the seamless woven material in a product output area 180 of the loom. The loom shown in FIG. 1A is depicted in a simplified form in order to demonstrate the basic principle of operation. However, it should be appreciated that the loom of FIG. 1A may comprise any or all of the loom elements described herein, such as any of the loom elements described with respect to any of FIGS. 1B-D, FIGS. 2A-E, FIGS. 3A-C, FIG. 4A or 4B, FIG. 5A or 5B, FIGS. 6A-C, FIG. 7, or FIG. 8. The various components of the loom are depicted in further detail in those drawings.

The loom may comprise a plurality of heddles, each of which may be individually raised or lowered along one or more axes of a heddle plane of the loom. Each of the heddles may be moved to a plurality of discrete positions along a longitudinal axis of the heddle planes, as described herein (for instance, with respect to FIGS. 5A and 5B).

For instance, as shown in FIG. 1A, the loom may comprise first, second, third, fourth, fifth, and sixth heddles 131*a*, 131*b*, 131*c*, 131*d*, 131*e*, and 131*f*, respectively. Each of the heddles may be configured to engage at least 1, at least 2, at least 3, at least 4, at least 5, at least 6, at least 7, at least 8, at least 9, or at least 10 warp strings. The heddles may engage the warp strings by any means known in the art. For instance, the warp strings may be threaded through one or more holes in the heddle. In FIG. 1A, each of the heddles is engaged with one warp string, such that the first, second, third, fourth, fifth, and sixth heddles are shown as engaging first, second, third, fourth, fifth, and sixth warp strings 141*a*, 141*b*, 141*c*, 141*d*, 141*e*, and 141*f*, respectively. Each of the heddles is independently activated by an actuator, as described herein (for instance, with respect to FIG. 5A or 5B). This allows, for example, for the first, second, third, fourth, fifth, and/or sixth heddle to be independently lowered or raised along a longitudinal axis of the heddle plane, as shown in FIG. 1A.

The total differential distance between a top most heddle and a bottom most heddle may be at least 1 mm, at least 2 mm, at least 3 mm, at least 4 mm, at least 5 mm, at least 6 mm, at least 7 mm, at least 8 mm, at least 9 mm, at least 10 mm, at least 20 mm, at least 30 mm, at least 40 mm, at least 50 mm, at least 60 mm, at least 70 mm, at least 80 mm, at least 90 mm, at least 100 mm, at least 200 mm, at least 300 mm, at least 400 mm, at least 500 mm, at least 600 mm, at least 700 mm, at least 800 mm, at least 900 mm, at least 1 m, at least 2 m, at least 3 m, at least 4 m, at least 5 m, at least 6 m, at least 7 m, at least 8 m, at least 9 m, or at least 10 m, or a distance that is within a range defined by any two of the preceding values.

In one embodiment, individual heddles or subsets of heddles are moved to different positions. Such different positions may be at different heights, such that they lie along or form a curved, curvilinear, or non-linear profile on the heddle plane. Two or more of the positions may be staggered relative to one another. Two or more of the positions may lie along a transverse axis of the heddle plane. Two or more of the positions may lie along a line that traverses non-orthogonally to the longitudinal axis of the heddle plane, such as in an upward-sloping or downward-sloping manner along the heddle plane. A plurality of positions may lie in a zig-zag fashion or profile along the heddle plane. A variety of different profiles may be achieved by modulating the positions of individual heddles on the heddle plane. In some instances heddles are arranged into sets, each with at least 2, at least 3, at least 4, at least 5, at least 6, at least 7, at least 8, at least 9, at least 10, or more heddles that are moved together, through at least some steps in the weaving process.

The individual raising or lowering of heddles to a plurality of positions may create a first local curvature 191*a* of the warp strings. The first local curvature may be locked into the seamless woven material by weaving one or more weft strings between the individually raised or lowered warp strings. The weft strings may be woven between the individually raised or lowered warp strings in a number of manners. For instance, the local curvature may be locked in using a one operation process. The one operation process may comprise weaving a weft string alternately between the warp strings while they are locked into their individually raised or lowered positions (such as the first, second, third, fourth, fifth, and sixth positions depicted in FIG. 1A).

Alternatively or in combination, the local curvature may be locked in using a two operation process. The two operation process may comprise a first operation of weaving a weft string under or above the individually raised or lowered warp strings (depending on whether each warp string was in a raised or lowered position). The positions of the individually raised or lowered warp strings may then be inverted (i.e., raised warp strings moved to lowered positions, and lowered warp strings moved to raised positions). The two operation process may comprise a second operation of weaving the same weft string above or under the inverted warp strings (opposite the weaving in the first operation), locking the first local curvature into the seamless woven material. Alternatively or in combination, the first and second operations may be accomplished using different weft strings.

The process of imparting local curvature into the seamless woven material may be repeated in order to produce variability in each of the three dimensions of the seamless woven material. For instance, as depicted in FIG. 1A, the seamless woven material may comprise first, second, third, and fourth local curvatures 191*a*, 191*b*, 191*c*, and 191*d*, respectively. The first, second, third, and fourth local curvatures may be the same or different. Each local curvature may be locked into the seamless woven material using one or more weft threads, in a manner similar to that described herein with respect to the first local curvature. The first, second, third, and fourth local curvatures may comprise any possible geometry. In this manner, the loom may produce a three-dimensional (3D) seamless woven material of any complexity.

Though depicted as comprising 6 heddles and 6 individually raised or lowered warp strings, the loom may comprise any number of heddles and any number of individually raised or lowered warp strings. For instance, the loom may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 heddles, or a number of heddles that is within a range defined by any two of the preceding values. The loom may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 individually raised or lowered warp strings, or a number of individually raised or lowered warp strings that is within a range defined by any two of the preceding values.

Though depicted as comprising 4 local curvatures, the seamless woven material may comprise any number of local curvatures (each local curvature locked into the woven material using one or more weft strings, as described herein). For instance, the seamless woven material may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 local curvatures, or a number of local curvatures that is within a range defined by any two of the preceding values.

The loom may be of a compact size. For instance, the loom may have an overall footprint of at most 100 $m^3$, at most 90 $m^3$, at most 80 $m^3$, at most 70 $m^3$, at most 60 $m^3$, at most 50 $m^3$, at most 40 $m^3$, at most 30 $m^3$, at most 20 $m^3$, at most 19 $m^3$, at most 18 $m^3$, at most 17 $m^3$, at most 16 $m^3$, at most 15 $m^3$, at most 14 $m^3$, at most 13 $m^3$, at most 12 $m^3$, at most 11 $m^3$, at most 10 $m^3$, at most 9 $m^3$, at most 8 $m^3$, at most 7 $m^3$, at most 6 $m^3$, at most 5 $m^3$, at most 4 $m^3$, at most 3 $m^3$, at most 2 $m^3$, or at most 1 $m^3$, or an overall footprint that is within a range defined by any two of the preceding values. For instance, the loom may have an overall footprint that is within a range from about 10 $m^3$ to about 15 $m^3$. The loom may have a maximum linear dimension of at most 20 m, at most 19 m, at most 18 m, at most 17 m, at most 16 m, at most 15 m, at most 14 m, at most 13 m, at most 12 m, at most 11 m, at most 10 m, at most 9 m, at most 8 m, at most 7 m, at most 6 m, at most 5 m, at most 4 m, at most 3 m, at most 2 m, or at most 1 m, or a maximum linear dimension that is within a range defined by any two of the preceding values. For instance, the loom may have a maximum linear dimension that is within a range from about 2 m to about 4 m.

Figure 4A:
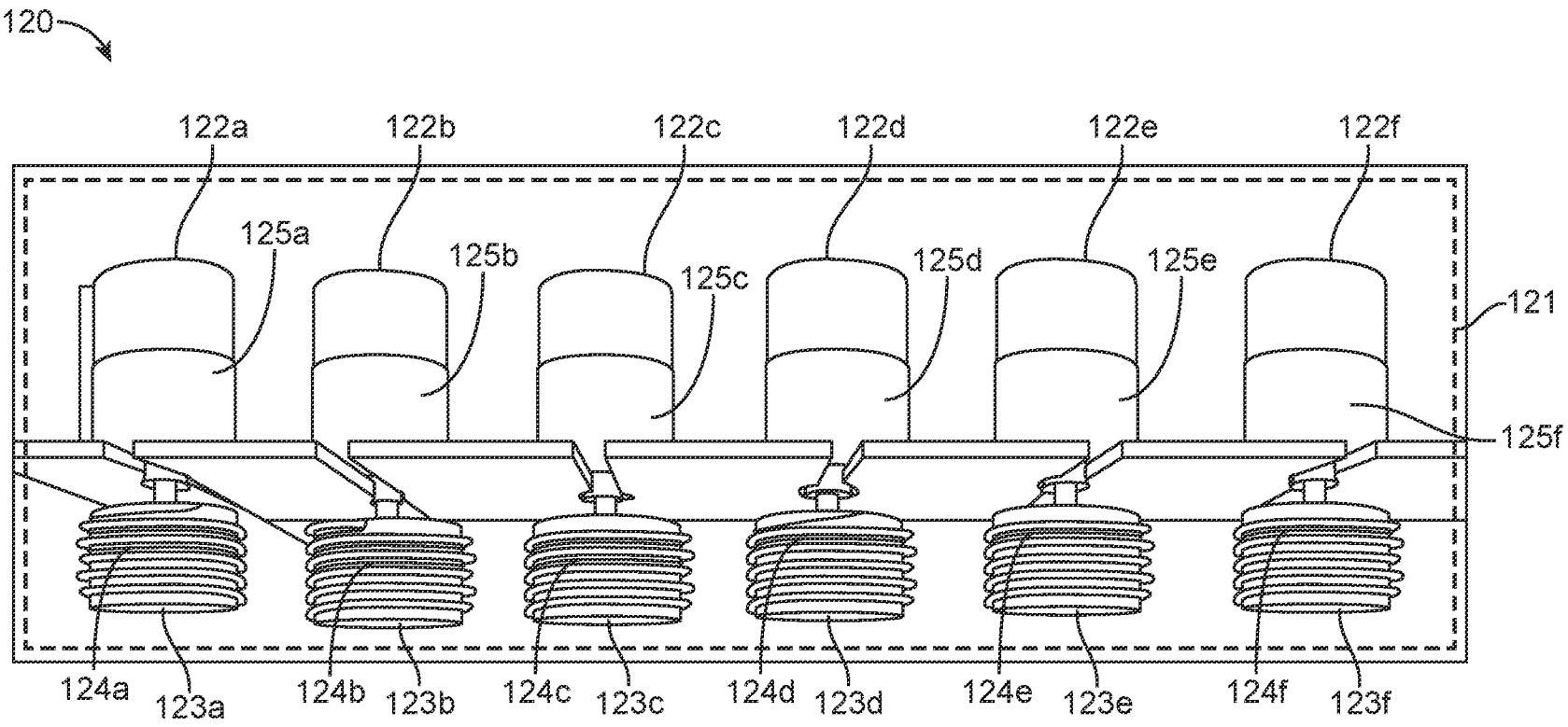
FIG. 4A shows an actuator system to be used in combination with a loom, in accordance with some embodiments.
Figure 5A:
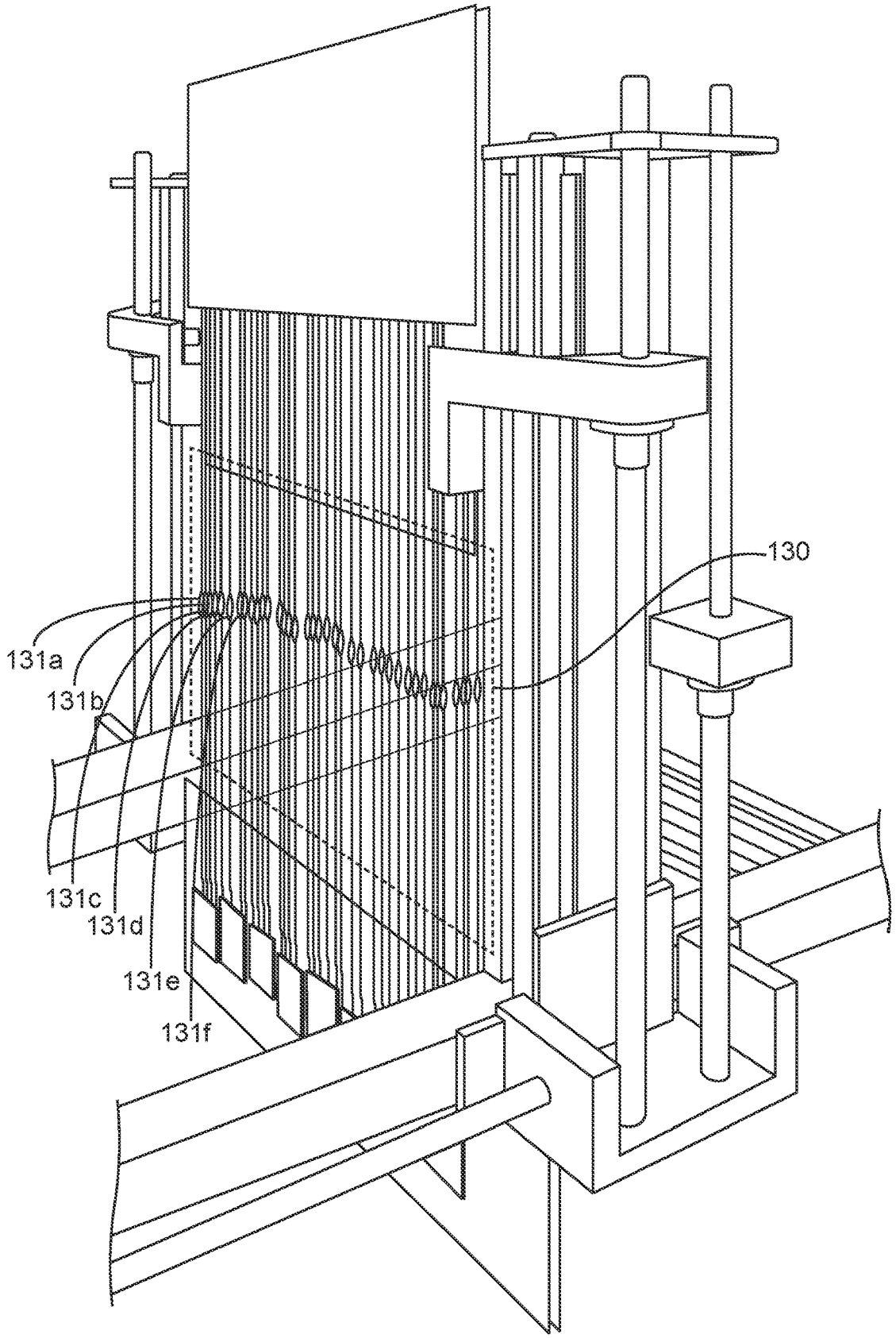
FIG. 5A shows a heddle system to be used in combination with a loom, in accordance with some embodiments.

The loom may comprise a plurality of individually controllable heddles, as described herein (for instance, with respect to FIG. 5A). The loom may be configured to weave fabric along a two-dimensional (2D) variable heddle plane to produce a seamless woven material (such as an article of clothing), as described herein. The loom may be configured to weave a 3D pattern of fabric without requiring cutting or stitching of 2D patterns of fabric to form the product (such as the article of clothing or any other woven material described herein). Alternatively or in combination, the loom may be configured to weave a 3D pattern of fabric requiring minimal cutting or stitching of 2D patterns of fabric to form the product. For instance, the loom may be configured to weave the 3D pattern of fabric using no more than 1, no more than 2, no more than 3, no more than 4, no more than 5, no more than 6, no more than 7, no more than 8, no more than 9, no more than 10, no more than 20, no more than 30, no more than 40, no more than 50, no more than 60, no more than 70, no more than 80, no more than 90, no more than 100, no more than 200, no more than 300, no more than 400, no more than 500, no more than 600, no more than 700, no more than 800, no more than 900, or no more than 1,000 cutting or stitching operations, or a number of cutting or stitching operations that is within a range defined by any two of the preceding values. The weaving of the fabric may comprise controlling each heddle to individually raise or lower each warp thread of a plurality of warp threads in a variable manner on the 2D heddle plane, and weaving a weft thread above, below, or through the plurality of warp threads to lock the fabric into a desired 3D form while each of the warp threads is individually raised or lowered, as described herein (for instance, with respect to FIG. 9). The plurality of heddles may be individually configured to move continuously between a plurality of positions along an axis of a heddle plane, as described herein (for instance, with respect to FIG. 5A). Each heddle may be individually controlled and configured to move independently of the other heddles. Alternatively or in combination, two or more of the heddles may be controlled to move collectively as a unit/subset of the plurality of heddles. A plurality of units/subsets of the heddles may be configured to move in concert with or relative to one another along the heddle plane. The loom may further comprise an actuation system configured to individually move each heddle, as described herein (for instance, with respect to FIG. 4A). The actuation system may comprise a plurality of motors, as described herein. Two or more of the heddles may be configured to move relative to one another, and the relative positions between the two or more heddles may be controllable to define local warp tangent angles of the warp threads that are moved by the heddles, as described herein (for instance, with respect to FIG. 10). Weaving of the fabric along the 2D heddle plane may comprise control of the local warp tangent angles to form the product (such as the article of clothing) having a desired form.

The loom system and weaving methods disclosed herein may be used to form woven materials with highly complex topographies and greater reliability (such as greater structural integrity), by manipulating materials (such as threads, fibers, etc.) via complex paths or patterns to leverage desirable material properties (such as excellent tensile strengths in certain directions). Such desirable characteristics may include delamination suppression, improved damage tolerance, impact resistance, fatigue life, improved torsional resistance, improved pull-off strength, etc. The loom system and weaving methods disclosed herein may be used, for instance, to great the seamless woven materials described herein (for instance, with respect to FIGS. 1D and 1E).

The loom described with respect to FIG. 1A may be optionally combined with any one or more systems described herein or used to implement any one or more methods described herein.

Figure 1B:
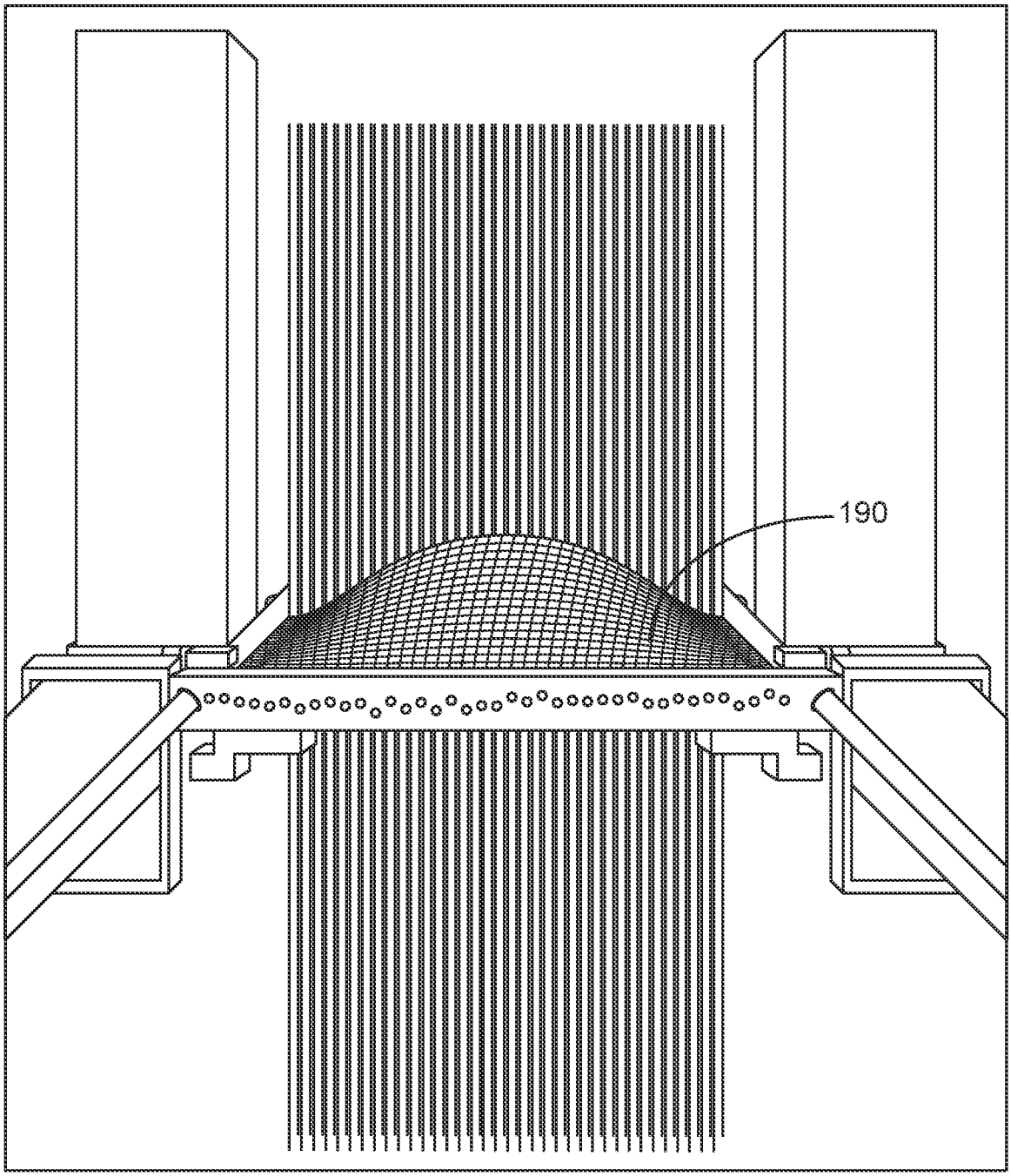
FIG. 1B shows a front view of a loom in the process of weaving an exemplary seamless woven material that is variable in each of its 3 dimensions, in accordance with some embodiments.

FIG. 1B shows a front view of a loom 100 in the process of weaving an exemplary seamless woven material 190 that is variable in each of its 3 dimensions. The loom described with respect to FIG. 1B may be optionally combined with any one or more systems described herein or used to implement any one or more methods described herein.

Figure 1C:
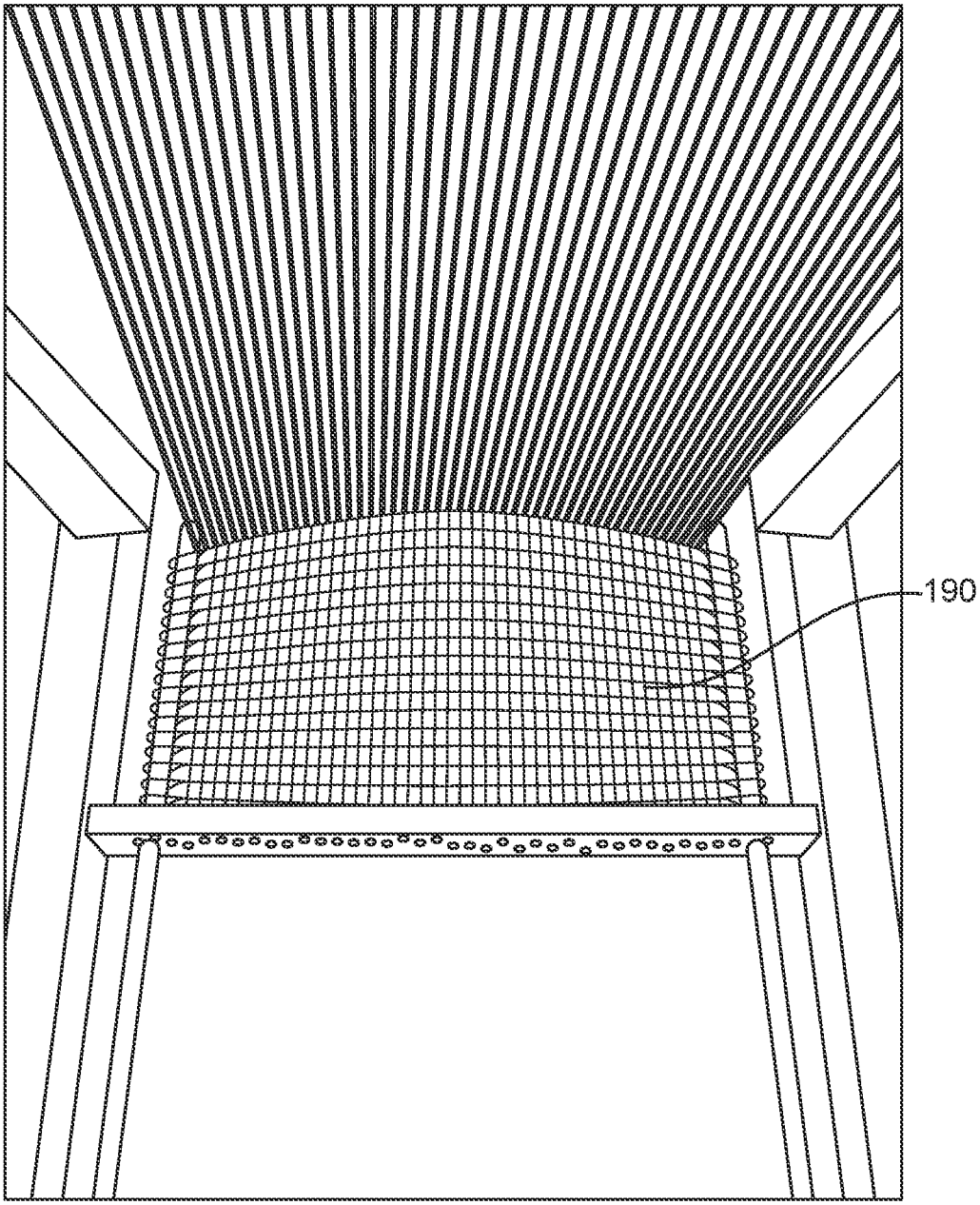
FIG. 1C shows a top view of a loom in the process of weaving an exemplary seamless woven material that is variable in each of its 3 dimensions, in accordance with some embodiments.

FIG. 1C shows a top view of a loom 100 in the process of weaving an exemplary seamless woven material 190 that is variable in each of its 3 dimensions. The loom described with respect to FIG. 1C may be optionally combined with any one or more systems described herein or used to implement any one or more methods described herein.

Figure 1D:
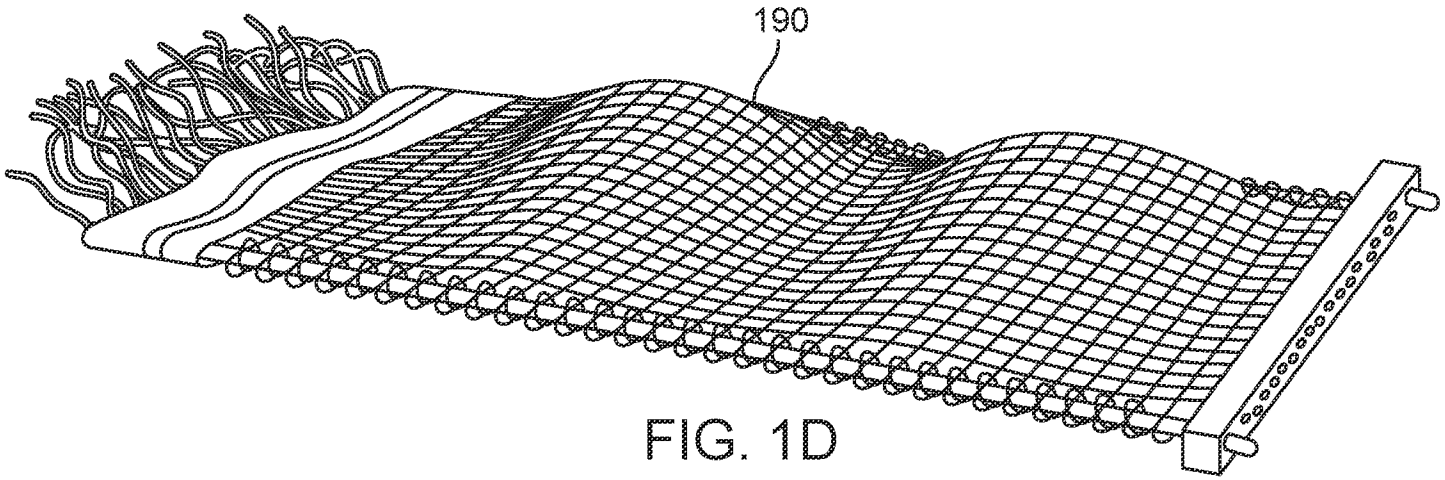
FIG. 1D shows an orthographic view of an exemplary seamless woven material that is variable in each of its 3 dimensions, in accordance with some embodiments.

FIG. 1D shows an orthographic view of an exemplary seamless woven material 190 that is variable in each of its 3 dimensions. The seamless woven material 190 may be any industrial seamless material. That is, the seamless woven material may be produced in an automated or semi-automated fashion, requiring little or no manual hand finishing. For instance, the seamless woven material may be produced with at most 10%, at most 9%, at most 8%, at most 7%, at most 6%, at most 5%, at most 4%, at most 3%, at most 2%, or at most 1% of the weaving operations completed by manual hand finishing. In some cases, no manual hand finishing may be required. Manual hand finishing may comprise any operation completely manually by hand, such as cutting manually by hand, sewing manually by hand, weaving manually by hand, or knitting manually by hand.

The seamless woven material may comprise any possible woven material as described in the following. The seamless woven material may comprise a complete product. The seamless woven material may comprise a partially finished product. The partially finished product may form a portion of a complete product. For instance, a plurality of three-dimensional woven materials (such as the three-dimensional woven materials produced by the looms described herein) may be stitched together to form complete products. At most 2, at most 3, at most 4, at most 5, at most 6, at most 7, at most 8, at most 9, at most 10, at most 20, at most 30, at most 40, at most 50, at most 60, at most 70, at most 80, at most 90, or at most 100 woven materials, or a number of woven materials that is within a range defined by any two of the preceding values, may be needed to form a complete product. This may be advantageous over existing methods for forming the final product, which may require at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, or at least 1,000 flat two-dimensional fabric pieces to form the same or a similar complete product.

The seamless woven material may comprise an article of clothing. For instance, the article of clothing may comprise a shirt, a shirt arm, a jacket, a jacket arm, a vest, a bulletproof vest, a pair of pants (as shown in FIG. 1F), a pant leg, a pair of shorts, a shoe, a sock, an undergarment, a pair of panties, a pair of boxers, a pair of briefs, a pair of boxer briefs, a bra, a sports bra, a headband, a hat, a helmet, a bulletproof helmet, a scarf, a leg brace, a knee brace, an ankle brace, an arm brace, a wrist brace, a shoulder brace, a back brace, a neck brace, a suit, a tie, a dress, a skirt, a poncho, a glove, a backpack, or a snowsuit.

The seamless woven material may comprise a recreational product. For instance, the recreational product may comprise a canoe, a kayak, a bicycle, a boat, a ski, a ski pole, a hiking pole, a hammock, a tent, a sleeping bag, a parachute, a net, a snowboard, a wakeboard, a skateboard, a tennis racquet, a table tennis racquet, a badminton racquet, a baseball bat, a baseball glove, a bow, an arrow, a cart, a case, a golf club, hunting equipment, a fishing rod, a cart, a case, a door, or a home installation.

The seamless woven material may comprise a biomedical device. For instance, the biomedical device may comprise a stent, a prosthetic, a crutch, a wheelchair, a cochlear implant, a suture, a vascular graft, a spinal repair, a tendon replacement, a ligament replacement, a containment sleeve, or a heart valve.

The seamless woven material may comprise component(s) for a satellite, a rocket, an aircraft, a car, housing, or a wind generator blade.

The seamless woven material may comprise any material that may be woven. For instance, the seamless woven material may comprise cotton, polyester, nylon, wool, silk, hemp, ramie, asbestos, coir, pina, sisal, jute, kapok, rayon, viscose, lyocell, linen, flax, acetate, triacetate, spandex, modal, polypropylene, acrylic, modacrylic, aramid, carbon fiber, or fiberglass. For woven materials comprising resins (such as woven materials made of materials such as fiberglass), the products may comprise a woven skeleton (such as a glass fiber skeleton for fiberglass) that may be impregnated with the resin and allowed to cure into a hardened form.

The seamless woven material may comprise an average thread density of at least 5, at least 10, at least 20, at least 30, at least 40, at least 50, at least 60, at least 70, at least 80, at least 90, at least 100, at least 200, at least 300, at least 400, at least 500, at least 60, at least 700, at least 800, at least 900, or at least 1,000 ends per inch (1 end per inch equals 1/25.4 ends per millimeter), or any average thread density that is within a range defined by any two of the preceding values.

The seamless woven material may comprise only warp threads and weft threads. The seamless woven material may comprise no bias threads. The seamless woven material may not or need not comprise a knit material. The seamless woven material may not or need not comprise a non-woven material. The warp threads and weft threads may be interwoven at an angle of approximately 90 degrees, approximately 85 degrees, approximately 80 degrees, approximately 75 degrees, approximately 70 degrees approximately 65 degrees, approximately 60 degrees, approximately 55 degrees, or approximately 50 degrees, or at any angle that is within a range defined by any two of the preceding values. The term "approximately", as used to describe angles, may be taken to mean that the angle is no more than 5 degrees larger or smaller than the specified angle.

The seamless woven material described with respect to FIG. 1D may be optionally produced using any one or more systems described herein or any one or more methods described herein.

Figure 1E:
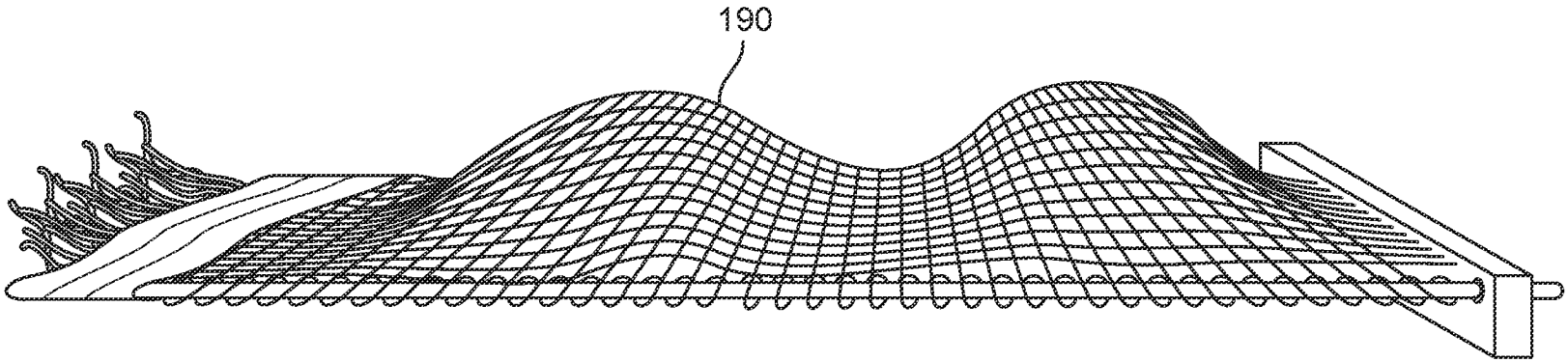
FIG. 1E shows a side view of an exemplary seamless woven material that is variable in each of its 3 dimensions, in accordance with some embodiments.
Figure 1F:
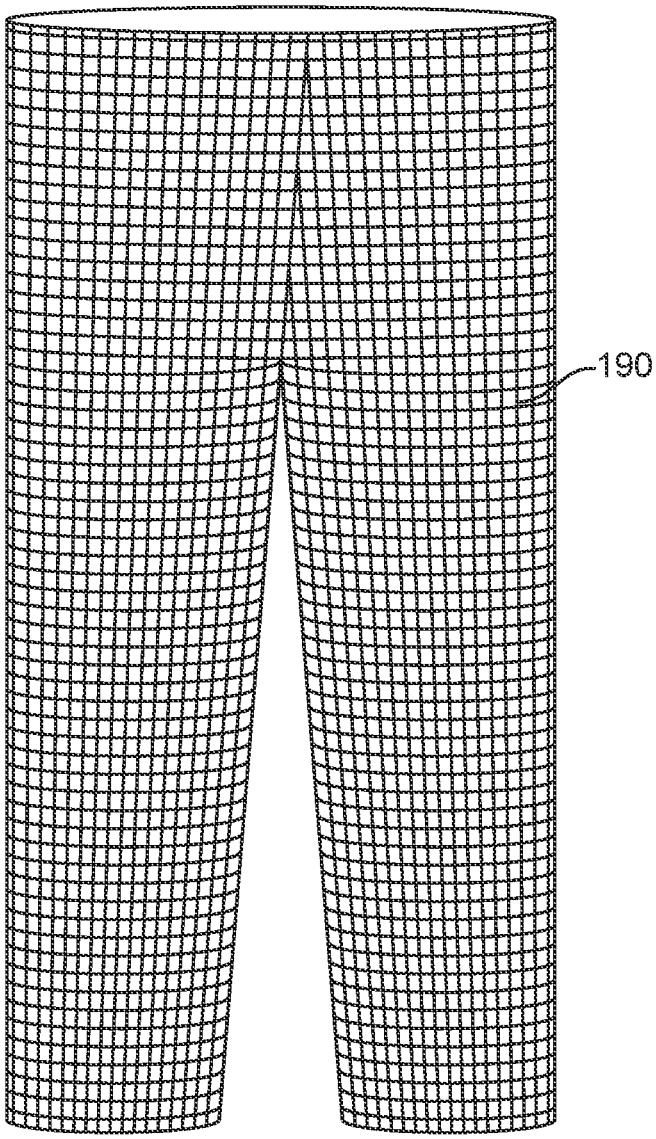
FIG. 1F shows an exemplary seamless woven pair of pants, in accordance with some embodiments.

FIG. 1E shows a side view of an exemplary seamless woven material 190 that is variable in each of its 3 dimensions.

The seamless woven material described with respect to FIG. 1E may be optionally produced using any one or more systems described herein or any one or more methods described herein.

FIG. 1F shows an exemplary seamless woven pair of pants 190. As shown in FIG. 1F, the pair of pants may comprise no seams and no manual hand woven sections.

The seamless woven pair of pants described with respect to FIG. 1F may be optionally produced using any one or more systems described herein or any one or more methods described herein.

Figure 2A:
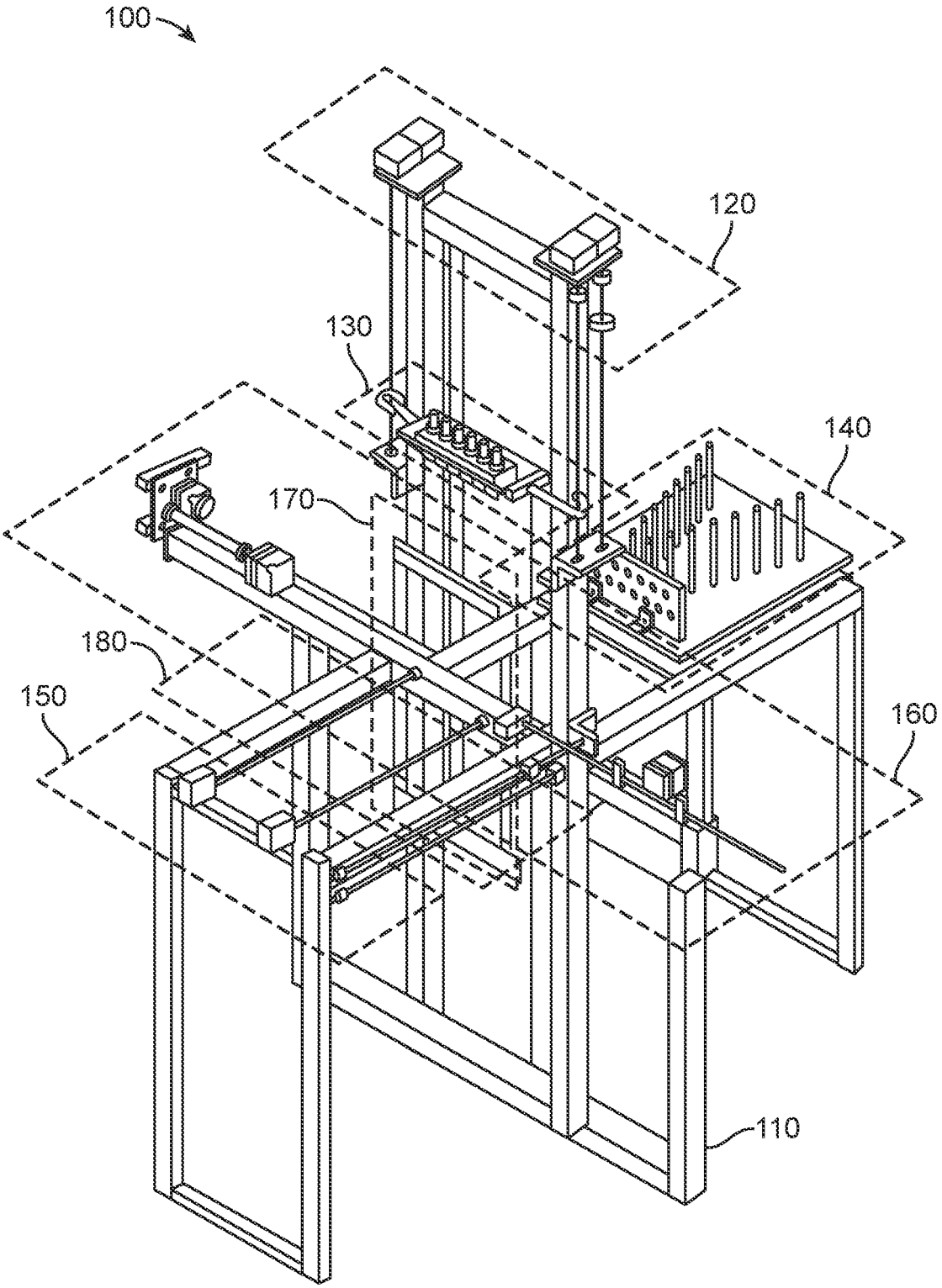
FIG. 2A shows a first orthographic view of a loom configured to weave a seamless woven material that is variable in each of its 3 dimensions, in accordance with some embodiments.

FIG. 2A shows a first orthographic view of a loom 100 configured to weave a seamless woven material 190 that is variable in each of its 3 dimensions. The loom may comprise one or more sub-systems. For instance, the loom may comprise any or all of a frame 110, an actuator system 120, a heddle system 130, a warp tension system 140, a fabric advancer 150, a weft system 160, a beating plane 170, and a product output area 180.

The frame 110 may be configured to support the other sub-systems of the loom.

The actuator system 120 may be attached or otherwise coupled to the frame. The actuator system may comprise a plurality of actuators, as described herein (for instance, with respect to FIG. 4A). The actuators may be arranged as a plurality of actuator modules, as described herein (for instance, with respect to FIG. 4B). Each actuator may be configured to individually raise or lower one or more heddles of the heddle module. For instance, each actuator may be coupled to one or more heddles by a wire or string. The wire or string may be moved by the actuator in order to raise or lower the heddles, as described herein.

Non-limiting examples of actuators or actuation elements suitable for use in embodiments of the present disclosure may include motors (such as brushless motors, direct current (DC) brush motors, rotational motors, servo motors, direct-drive rotational motors, DC torque motors, linear solenoids stepper motors, ultrasonic motors, geared motors, speed-reduced motors, or piggybacked motor combinations), magnets, electromagnets, pneumatic actuators, hydraulic actuators, gears, cams, linear drives, belts, pulleys, conveyors, and the like. Non-limiting examples of spring elements that may be used for actuation or string/wire tensioning may include a variety of suitable spring types (such as nested compression springs, buckling columns, conical springs, variable-pitch springs, snap-rings, double torsion springs, wire forms, limited-travel extension springs, braided-wire springs, etc.).

The heddle system 130 may be attached or otherwise coupled to the frame. The heddle system may comprise a plurality of heddles that may be individually raised or lowered, as described herein (for instance, with respect to FIG. 5A). The raising or lowering of the individual heddles may allow raising or lowering of individual warp strings of a seamless woven material to create a local structure, as described herein (for instance, with respect to FIG. 5B).

The warp tension system 140 may be attached or otherwise coupled to the frame. The warp tension system may comprise a plurality of warp tensioners, as described herein (for instance, with respect to FIG. 6A). The warp tensioners may provide a tension to individual warp strings during the weaving process, as described herein (for instance, with respect to FIGS. 6A-C).

The fabric advancer system 150 may be attached or otherwise coupled to the frame. The fabric advancer system may be configured to advance the semi-woven material in a direction away from the heddle plane as the product is being woven.

The weft system 160 may be attached or otherwise coupled to the frame. The weft system may comprise a number of components, as described herein (for instance, with respect to FIG. 8). The weft system may be configured to weave weft string through individually raised or lowered warp strings, as described herein. The weft system may weave a continuous weft yarn throughout the product. Alternatively or in combination, the weft system may weave a plurality of weft yarns throughout the product. For instance, the weft system may weave at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, or at least 1,000 weft yarns, or a number of weft yarns that is within a range defined by any two of the preceding values, throughout the product.

The beating plane 170 may be attached or otherwise coupled to the frame. The beating plane may compact weft strings that have been woven through individually raised or lowered warp strings.

The product output area 180 may be the location of the loom in which the seamless woven material is produced.

The loom described with respect to FIG. 2A may be optionally combined with any one or more systems described herein or used to implement any one or more methods described herein.

Figure 2B:
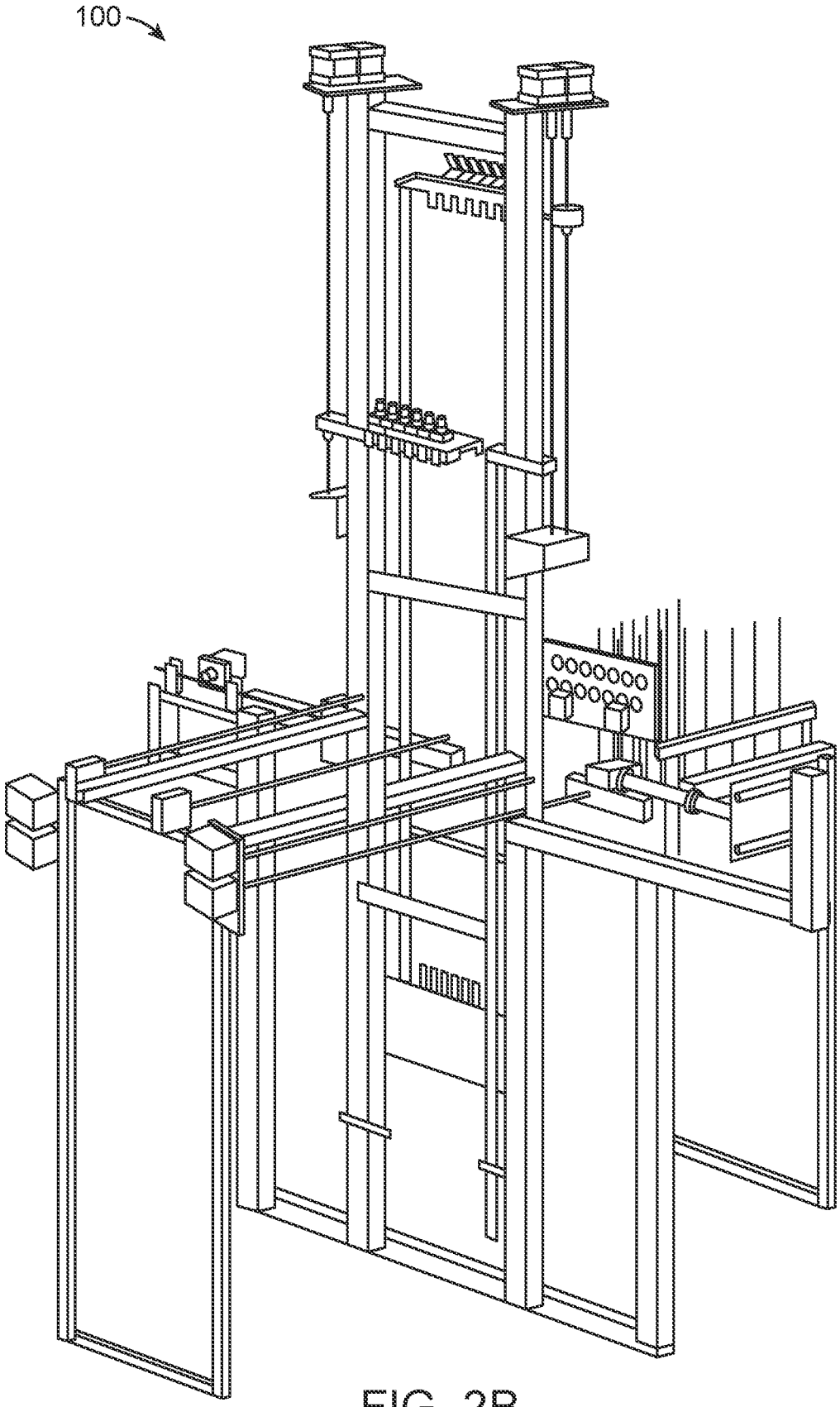
FIG. 2B shows a second orthographic view of a loom configured to weave a seamless woven material that is variable in each of its 3 dimensions, in accordance with some embodiments.

FIG. 2B shows a second orthographic view of a loom 100 configured to weave a seamless woven material that is variable in each of its 3 dimensions.

The loom described with respect to FIG. 2B may be optionally combined with any one or more systems described herein or used to implement any one or more methods described herein.

Figure 2C:
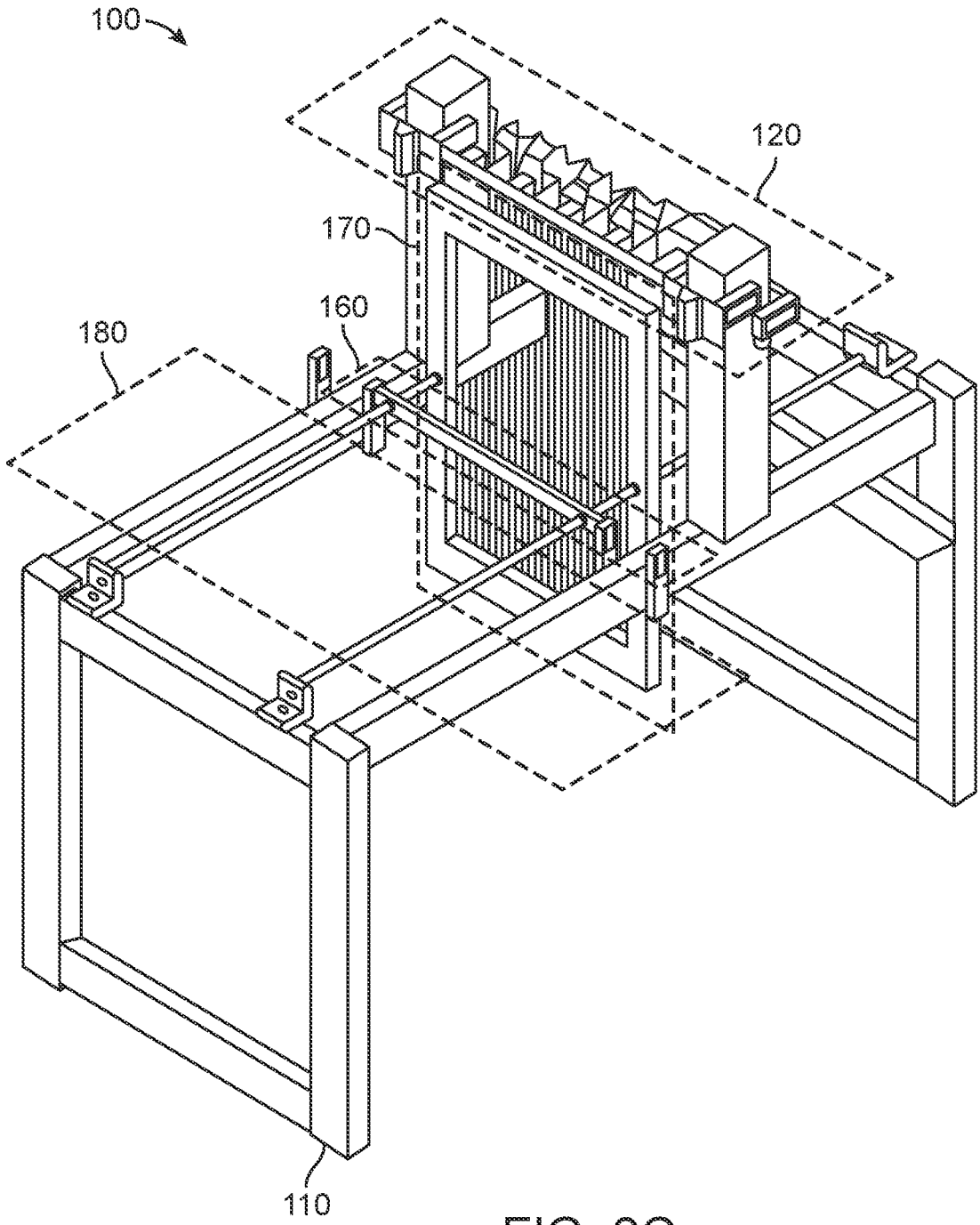
FIG. 2C shows a cutaway orthographic view of a loom configured to weave a seamless woven material that is variable in each of its 3 dimensions, the cutaway emphasizing the frame, actuator system, beating plane, and product output area of the loom, in accordance with some embodiments.

FIG. 2C shows a cutaway orthographic view of a loom 100 configured to weave a seamless woven material that is variable in each of its 3 dimensions. The cutaway shows in greater detail the frame 110, actuator system 120, beating plane 170, and product output area 180 of the loom.

The loom described with respect to FIG. 2C may be optionally combined with any one or more systems described herein or used to implement any one or more methods described herein.

Figure 2D:
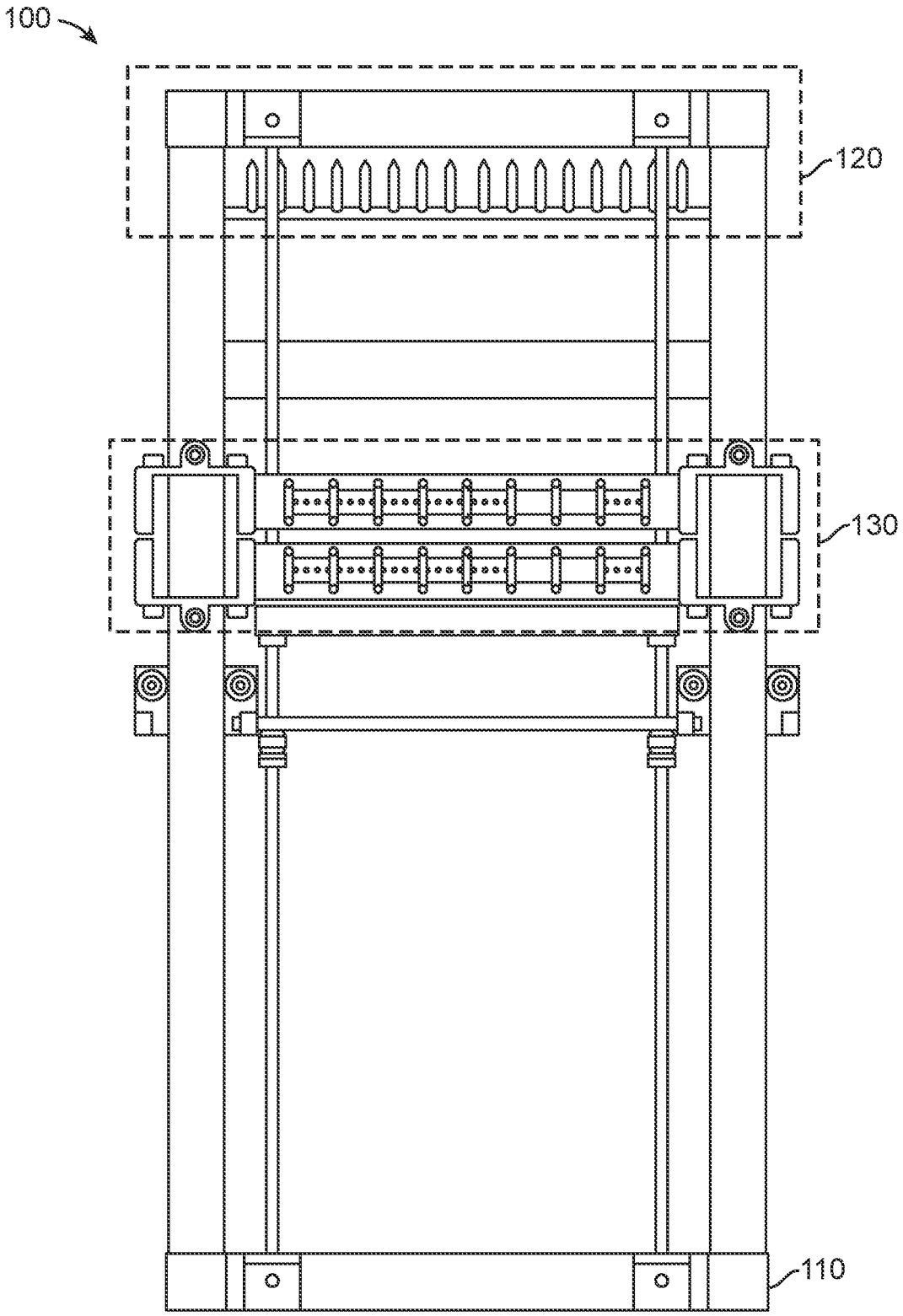
FIG. 2D shows a top view of a loom configured to weave a seamless woven material that is variable in each of its 3 dimensions, the front view emphasizing the frame, actuator system, and heddle system of the loom, in accordance with some embodiments.

FIG. 2D shows a top view of a loom 100 configured to weave a seamless woven material that is variable in each of its 3 dimensions. The front view shows in greater detail the frame 110, actuator system 120, and heddle system 130 of the loom.

The loom described with respect to FIG. 2D may be optionally combined with any one or more systems described herein or used to implement any one or more methods described herein.

Figure 2E:
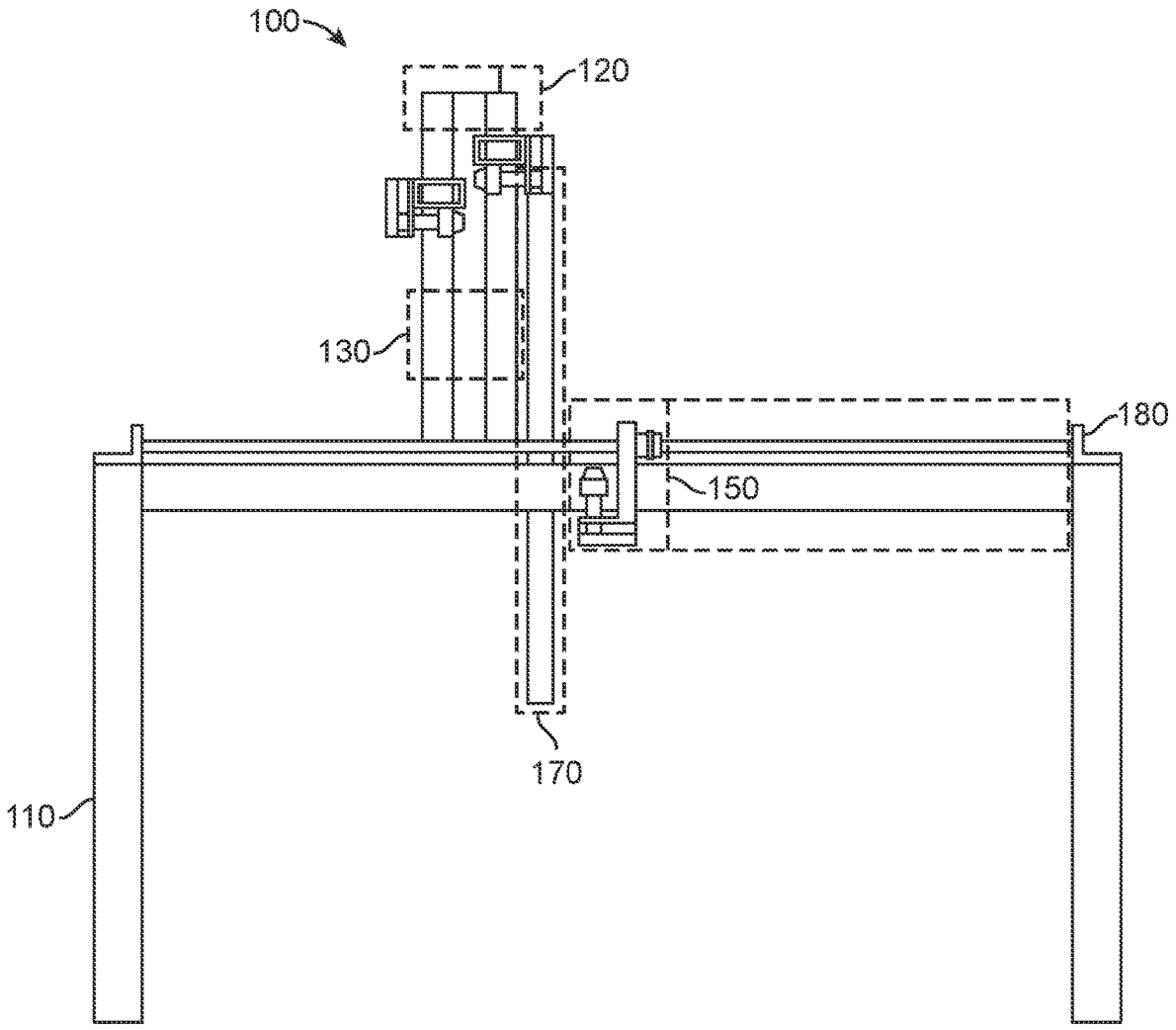
FIG. 2E shows a side view of a loom configured to weave a seamless woven material that is variable in each of its 3 dimensions, the side view emphasizing the frame, actuator system, heddle system, fabric advancer, beating plane, and product output area of the loom, in accordance with some embodiments.

FIG. 2E shows a side view of a loom 100 configured to weave a seamless woven material that is variable in each of its 3 dimensions. The side view shows in greater detail the frame 110, actuator system 120, heddle system 130, fabric advancer 150, beating plane 170, and product output area 180 of the loom.

The loom described with respect to FIG. 2E may be optionally combined with any one or more systems described herein or used to implement any one or more methods described herein.

Figure 3A:
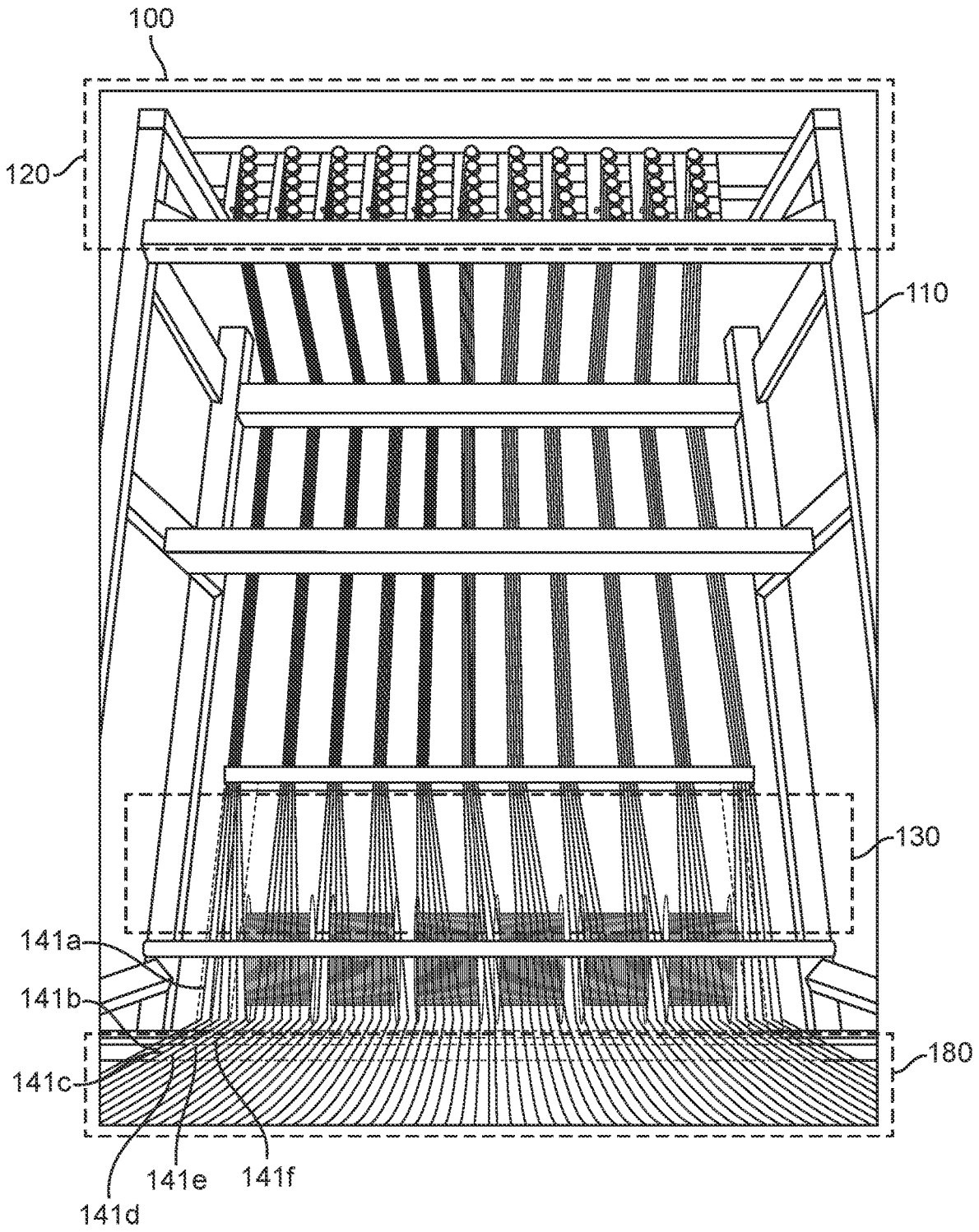
FIG. 3A shows a front view of a loom in the process of weaving a seamless woven material that is variable in each of its 3 dimensions, the front view emphasizing the frame, actuator system, heddle system, warp strings, and product output area of the loom, in accordance with some embodiments.

FIG. 3A shows a front view of a loom 100 in the process of weaving a seamless woven material that is variable in each of its 3 dimensions. The front view shows in greater detail the frame 110, actuator system 120, heddle system 130, warp strings 141*a*, 141*b*, 141*c*, 141*d*, 141*e*, 141*f*, and product output area 180 of the loom. As shown to the left in FIG. 3A, individual heddles associated with first, second, third, fourth, fifth, and sixth warp strings 141*a*, 141*b*, 141*c*, 141*d*, 141*e*, 141*f*, respectively, have been raised to different locations, causing the warp strings to assume a curved, curvilinear, or non-linear local structure along a plane perpendicular to the warp strings.

The loom described with respect to FIG. 3A may be optionally combined with any one or more systems described herein or used to implement any one or more methods described herein.

Figure 3B:
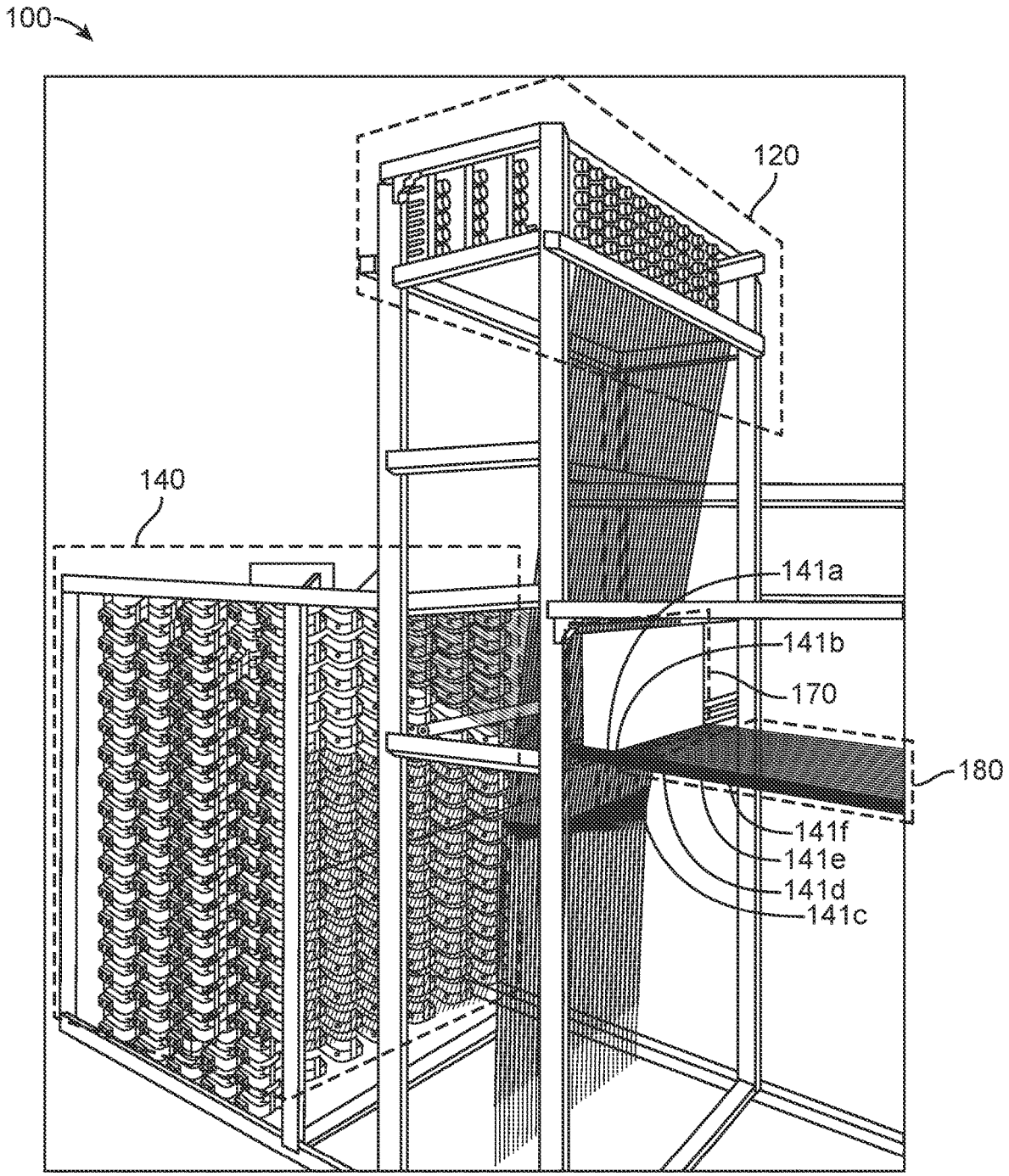
FIG. 3B shows an orthographic view of a loom in the process of weaving a seamless woven material that is variable in each of its 3 dimensions, the orthographic view emphasizing the frame, actuator system, warp strings, warp tension system, beating plane, and product output area of the loom, in accordance with some embodiments.

FIG. 3B shows an orthographic view of a loom 100 in the process of weaving a seamless woven material that is variable in each of its 3 dimensions. The orthographic view shows in greater detail the frame 110, actuator system 120, warp strings 141*a*, 141*b*, 141*c*, 141*d*, 141*e*, 141*f*, warp tension system 140, beating plane 170, and product output area 180 of the loom.

The loom described with respect to FIG. 3B may be optionally combined with any one or more systems described herein or used to implement any one or more methods described herein.

Figure 3C:
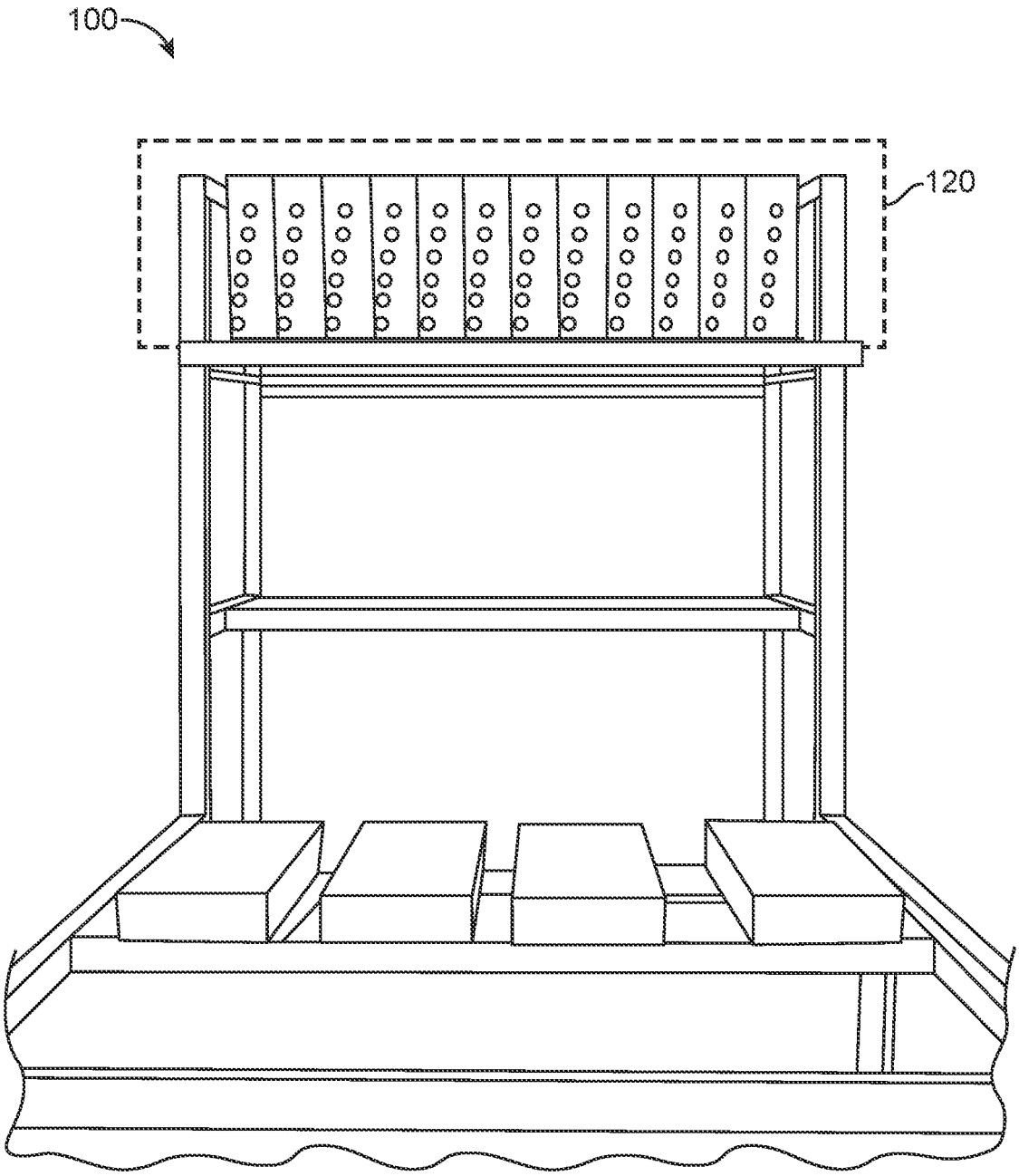
FIG. 3C shows a back view of a loom in the process of weaving a seamless woven material that is variable in each of its 3 dimensions, the back view emphasizing the frame, actuator system, and warp tension system of the loom, in accordance with some embodiments.

FIG. 3C shows a back view of a loom 100 in the process of weaving a seamless woven material that is variable in each of its 3 dimensions. The back view shows in greater detail the frame 110, actuator system 120, and warp tension system 140 of the loom.

The loom described with respect to FIG. 3C may be optionally combined with any one or more systems described herein or used to implement any one or more methods described herein.

FIG. 4A shows an actuator system 120 to be used in combination with a loom. The actuator system may be used in combination with the loom 100 disclosed herein. Alternatively or in combination, the actuator system may be used with any other loom that is not disclosed herein. The actuator system may comprise an actuator module 121. The actuator system may comprise a plurality of motors and a plurality of couplings coupled to the plurality of motors. The plurality of couplings may be arranged in a configuration that allows one or more heddles of the loom to be individually controlled and actuated continuously between a plurality of positions. Each motor may be mechanically coupled to one coupling. Each motor may be coupled to one heddle. In this manner, each heddle may be individually raised or lowered by a separate motor. Each of the couplings may be configured to reduce an angular velocity imparted to one or more coupled motors. The angular velocity may be associated with one or more torques due to a gravitational force or a spring force imparted on one or more heddles.

Each coupling may comprise a gear reduction component and a pulley system. The pulley system may be threaded. The pulley system may be non-threaded. The gear reduction component may be disposed between a motor and the pulley component. The gear reduction component may comprise at least two gears of different pitch diameters or different numbers of teeth. The gear reduction component may reduce a torque-induced turning of a motor. The torque-induced turning of the motor may be associated with a torque due to a gravitational force or a spring force on a heddle coupled to the motor. The gear reduction component may comprise at least a 10:1, at least a 20:1, at least a 30:1, at least a 40:1, at least a 50:1, at least a 60:1, at least a 70:1, at least a 80:1 at least a, 90:1, or at least a 100:1 gear reduction ratio, or a gear reduction ratio that is within a range defined by any two of the preceding values.

The couplings may allow the motors to be actuated in a controlled manner during an operation of the heddles. The configuration of the plurality of couplings may enable power consumption to be reduced by obviating a need to provide a continuous torque to the one or more heddles during one or more passes of a weft thread across the loom.

The actuator system may be configured to draw an electrical power of at most 1 Watt (W), at most 2 W, at most 3 W, at most 4 W, at most 5 W, at most 6 W, at most 7 W, at most 8 W, at most 9 W, at most 10 W, at most 20 W, at most 30 W, at most 40 W, at most 50 W, at most 60 W, at most 70 W, at most 80 W, at most 90 W, at most 100 W, at most 200 W, at most 300 W, at most 400 W, at most 500 W, at most 600 W, at most 700 W, at most 800 W, at most 900 W, at most 1 kW, at most 2 kW, at most 3 kW, at most 4 kW, at most 5 kW, at most 6 kW, at most 7 kW, at most 8 kW, at most 9 kW, at most 10 kW, at most 20 kW, at most 30 kW, at most 40 kW, at most 50 kW, at most 60 kW, at most 70 kW, at most 80 kW, at most 90 kW, at most 100 kW, or an electrical power that is within a range defined by any two of the preceding values. The actuator system may be configured to draw an electrical power of at most 1 W, at most 2 W, at most 3 W, at most 4 W, at most 5 W, at most 6 W, at most 7 W, at most 8 W, at most 9 W, or at most 10 W, or an electrical power that is within a range defined by any two of the preceding values, for one or more of the motors. For instance, each motor may be configured to draw an electrical power than is within a range from about 1 W to about 5 W. Each motor may comprise a brushed direct current (DC) motor, a brushless DC motor, a servo motor, or a stepper motor. Each motor may be configured to move (e.g. translate) each heddle along one or more axes of a heddle plane of the loom.

The actuator system may comprise a plurality of electronic controllers. The electronic controllers may be configured to output electrical signals to the plurality of motors. The electrical signals may control motion of the motors to effect changes in position of one or more of the heddles. For instance, the electrical signals may specify instructions for the motors to turn in order to raise or lower a heddle by a particular distance. The electrical signals may specify instructions for the motors to raise or lower a heddle at a particular speed or acceleration. The plurality of positions may comprise at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000 discrete positions along a longitudinal axis of the heddle plane, or a number of discrete positions along a longitudinal axis of the heddle plane that is within a range defined by any two of the preceding values. A distance between two adjacently spaced discrete positions may be at least about 0.01 mm, at least about 0.02 mm, at least about 0.03 mm, at least about 0.04 mm, at least about 0.05 mm, at least about 0.06 mm, at least about 0.07 mm, at least about 0.08 mm, at least about 0.09 mm, at least about 0.1 mm, at least about 0.2 mm, at least about 0.3 mm, at least about 0.4 mm, at least about 0.5 mm, at least about 0.6 mm, at least about 0.7 mm, at least about 0.8 mm, at least about 0.9 mm, at least about 1 mm, at least about 2 mm, at least about 3 mm, at least about 4 mm, at least about 5 mm, at least about 6 mm, at least about 7 mm, at least about 8 mm, at least about 9 mm, or at least about 10 mm, or a distance that is within a range defined by any two of the preceding values. For instance, a distance between two adjacently spaced discrete positions may be within a range from about 0.04 mm to about 0.06 mm.

The electronic controllers may comprise software and/or hardware components. The electronic controllers may include one or more processors and at least one memory for storing program instructions. The processor(s) may be single or multiple microprocessors, field programmable gate arrays (FPGAs), application-specific integrated circuits (ASICs), or digital signal processors (DSPs) capable of executing particular sets of instructions. Computer-readable instructions may be stored on a tangible non-transitory computer-readable medium, such as a flexible disk, a hard disk, a CD-ROM (compact disk-read only memory), and MO (magneto-optical), a DVD-ROM (digital versatile disk-read only memory), a DVD RAM (digital versatile disk-random access memory), or a semiconductor memory. Alternatively or in combination, the program instructions may be implemented in hardware components or combinations of hardware and software such as, for example, special purpose computers, or general purpose computers.

Figure 11:
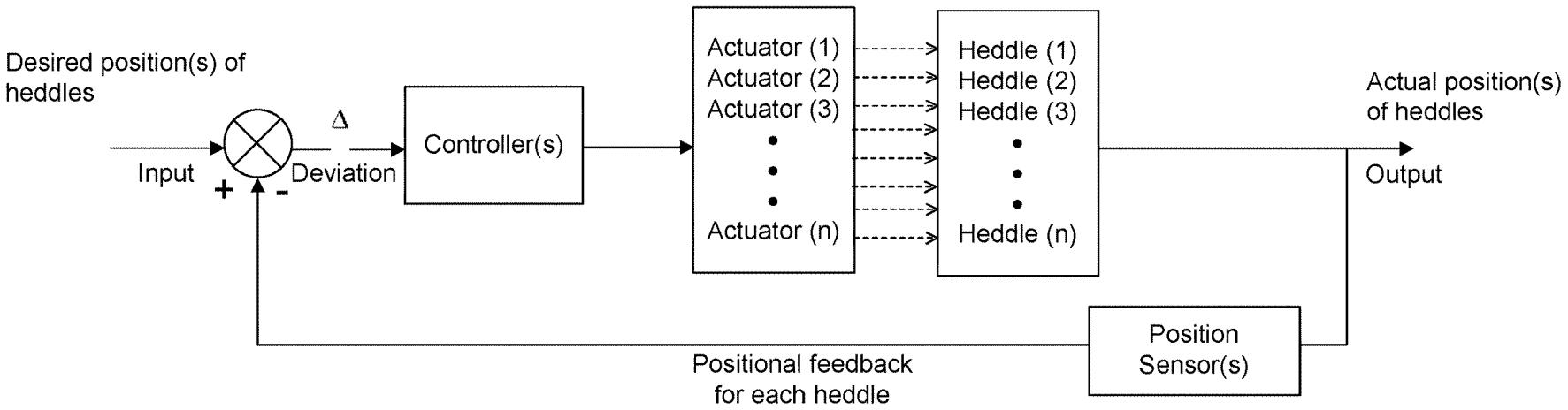
FIG. 11 shows a scheme for a positional sensing system to be used in controlling a plurality of heddles.

For instance, the electronic controllers may comprise a position sensing and feedback functionality, as described herein (for instance, with reference to FIG. 11).

In some examples, a positional sensing system may be provided for the plurality of heddles. The positional sensing system may be used to facilitate or improve control of individual heddles. For example, a position sensor may be provided for or operably coupled to each heddle. The position sensor may include, for example, a magnetic field sensor, an optical sensor, or an inertial sensor. Each position sensor may be configured to generate signals in response to changes in position of the corresponding heddle. The signals may be indicative of the positions of the heddles relative to one another, and/or relative to the heddle plane. The signals may vary as individual heddles move between different positions along the heddle plane. The electronic controllers may be configured to receive and analyze signals from the position sensors to determine a local position of each heddle. The local position of each heddle may be computed relative to a coordinate system for the heddle plane. The electronic controllers may be configured to control motion of the motors to effect changes in position of one or more of the heddles, based on the detected positions of the heddles.

For instance, FIG. 11 illustrates a block diagram of a control system for controlling individual positions of a plurality of heddles. The control system may comprise a controller, a plurality of actuators (labeled 1 through n in FIG. 11, with n being any possible integer), a plurality of heddles (labeled 1 through n in FIG. 11, with n being any possible integer), and one or more position sensor(s) operably connected together via a feedback loop. The plurality of heddles may be individually controllable, as described herein (for instance, with respect to FIG. 4A or 4B), and may be configured to be individually raised or lowered along the heddle plane by the actuators, as described herein (for instance, with respect to FIG. 5A or 5B).

The controller may be configured to control and track the position and/or movement of the plurality of heddles, based on positional feedback obtained from the sensors as the heddles move along the heddle plane.

An input may be initially provided to the control system. The input may comprise one or more desired positions of the plurality of heddles. The desired positions may be associated with a desired curved, curvilinear, or non-linear profile on the heddle plane. The controller may be configured to generate signals for controlling the plurality of actuators to move the heddles along the heddle plane based on the input. One or more of the heddles may be selectively activated and moved along the heddle plane. The positions of individual heddles may be determined based on sensing signals obtained by one or more position sensors. In some instances, the movements, such as the velocities and/or accelerations, of individual heddles may be determined based on sensing signals obtained by one or more speedometers, accelerometers, and the like. The sensing signals may be generated by the sensors as the heddles move on the heddle plane. The heddles may be configured to move at a speed of at least 1 mm/s, at least 2 mm/s, at least 3 mm/s, at least 4 mm/s, at least 5 mm/s, at least 6 mm/s, at least 7 mm/s, at least 8 mm/s, at least 9 mm/s, at least 10 mm/s, at least 20 mm/s, at least 30 mm/s, at least 40 mm/s, at least 50 mm/s, at least 60 mm/s, at least 70 mm/s, at least 80 mm/s, at least 90 mm/s, at least 100 mm/s, at least 200 mm/s, at least 300 mm/s, at least 400 mm/s, at least 500 mm/s, at least 600 mm/s, at least 700 mm/s, at least 800 mm/s, at least 900 mm/s, at least 1 m/s, at least 2 m/s, at least 3 m/s, at least 4 m/s, at least 5 m/s, at least 6 m/s, at least 7 m/s, at least 8 m/s, at least 9 m/s, at least 10 m/s, or a speed that is within a range defined by any two of the preceding values.

An actual path (which may include an actual position, speed, and/or acceleration) of each individual heddle may be determined based on the sensing signals. The actual path may be compared against the input to determine an amount of deviation (if any) from the desired paths (desired position, speed, and/or acceleration) of the individual heddle. The controller may be configured to adjust the position (and/or speed or acceleration) of one or more of the heddles by adjusting a control signal (such as an electric current or voltage) to the corresponding actuator based on the amount of deviation. The controller may be configured to adjust the position (and/or speed or acceleration) of each individual heddle in this manner.

The corrections may be imparted by any feedback mechanism, such as a proportional-integral-derivative (PID) control mechanism. The heddle positions may be altered over time to form different two-dimensional fabric cross-sections. For instance, the heddle positions may be altered at first, second, third, fourth, and fifth points in time t1, t2, t3, t4, and t5 to form the four profiles shown in FIGS. 12A-E. Though depicted as operating over five points in time to form five profiles, any one or more of the heddle positions may be altered at any number of points in time to form any number of profiles. For instance, any one or more of the heddle positions may be altered at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, or at least 1,000 points in time, or at a number of points in time that is within a range defied by any two of the preceding values. Any one or more of the heddle positions may be altered to form at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, or at least 1,000 profiles, or at a number of profiles that is within a range defined by any two of the preceding values.

The control system described with respect to FIG. 11 may be optionally combined with any one or more systems described herein or used to implement any one or more methods described herein.

Figure 12A:
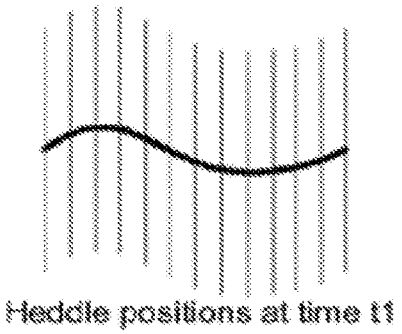
FIG. 12A shows exemplary heddle positions at a first point in time.

FIG. 12A shows exemplary heddle positions at a first point in time t1. The heddles may assume the generally open form or profile depicted in FIG. 12A.

Figure 12B:
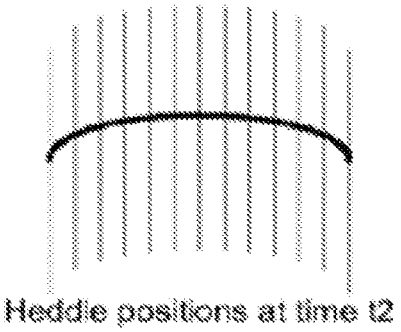
FIG. 12B shows exemplary heddle positions at a second point in time.

FIG. 12B shows exemplary heddle positions at a second point in time t2. The heddles may assume the generally open form or profile depicted in FIG. 12B.

Figure 12C:
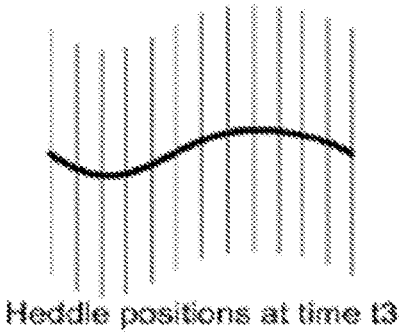
FIG. 12C shows exemplary heddle positions at a third point in time.

FIG. 12C shows exemplary heddle positions at a third point in time t3. The heddles may assume the generally open form or profile depicted in FIG. 12C.

Figure 12D:
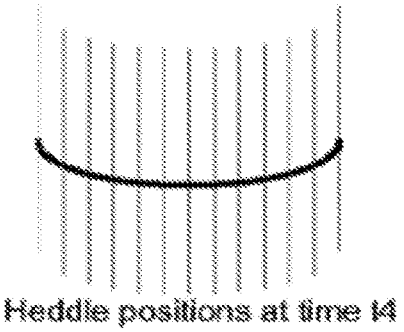
FIG. 12D shows exemplary heddle positions at a fourth point in time.

FIG. 12D shows exemplary heddle positions at a fourth point in time t4. The heddles may assume the generally open form or profile depicted in FIG. 12D.

Figure 12E:
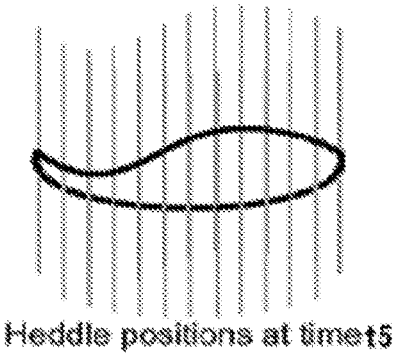
FIG. 12E shows exemplary heddle positions at a fifth point in time.

FIG. 12E shows exemplary heddle positions at a fifth point in time t5. The heddles may assume the generally closed form or profile depicted in FIG. 12E.

The heddles may assume any possible open form or profile at any point in time. For instance, the heddles may assume a form or profile characterized by arranging the heddles to lie along any single open-ended curve (such as any of those depicted in FIGS. 12A-D, or any other possible open-ended curve). The heddles may assume any possible closed form or profile at any point in time. For instance, the heddles may assume a form or profile characterized by arranging the heddles to lie along any closed curve (such as that depicted in FIG. 12E, or any other possible closed curve). A closed form or profile may comprise a reduced woven thread density in comparison with an open form or profile. For instance, a closed form or profile may comprise a woven thread density that is approximately half that of an open form or profile.

As shown in FIG. 4A, the actuator system may comprise first, second, third, fourth, fifth, and sixth motors 122*a*, 122*b*, 122*c*, 122*d*, 122*e*, and 122*f*, respectively. Each of the first, second, third, fourth, fifth, and sixth motors may be coupled to first, second, third, fourth, fifth, and sixth couplings 123*a*, 123*b*, 123*c*, 123*d*, 123*e*, and 123*f*, respectively. The first, second, third, fourth, fifth, and sixth couplings may comprise first, second, third, fourth, fifth, and sixth pulleys 124*a*, 124*b*, 124*c*, 124*d*, 124*e*, and 124*f*, respectively, and first, second, third, fourth, fifth, and sixth gear reduction components, 125*a*, 125*b*, 125*c*, 125*d*, 125*e*, and 125*f*, respectively. Each of the gear reduction components may be coupled to the corresponding pulley. The first, second, third, fourth, fifth, and sixth pulleys may be coupled to first, second, third, fourth, fifth, and sixth heddle strings or wires 126*a*, 126*b*, 126*c*, 126*d*, 126*e*, and 126*f*, respectively. The heddle strings or wires may be coupled to heddles that may be individually raised or lowered.

When, for instance, the first motor 122*a* is rotated, this rotation may be translated, through the first gear reduction component 125*a*, to the first pulley 124*a*, causing the first pulley to rotate. The first heddle string or wire 126*a* may be wound or unwound along grooves in the first pulley, depending on the direction of rotation of the first motor. Winding of the first heddle string or wire may cause a heddle to move in an upward direction, raising the associated heddle and any warp string that may be wound through the associated heddle. Unwinding of the first heddle string or wire may cause a heddle to move in a downward direction, lowering the associated heddle and any warp string that may be wound through the associated heddle. Thus, rotational motion of the first motor may raise or lower a heddle to any desired position. A similar raising or lowering of other heddles and warp strings may be caused by rotation of the second, third, fourth, fifth, or sixth motors.

Absent the gear reduction components, a motor may be subject to a torque, such as a torque due to a gravitational force or a spring force on a heddle coupled to the motor. The torque may tend to cause undesired rotation of the motor, causing the heddle to move downward when such downward motion is not desired. This may be true even when the motor used is a stepper motor or servo motor. The gear reduction component may significantly slow the downward motion, allowing a weft string to be woven through individually raised or lowered warp strings associated with the heddles before the heddles are able to move an appreciable distance downward. This mode of operation may obviate the need for electrical power to be supplied at times other than when intentional heddle movement to a different position is desired. This may significantly reduce the amount of electrical power required to operate the actuator system.

Though depicted as comprising 6 motors, 6 couplings (each comprising a gear reduction component and a pulley), and 6 heddle strings or wires, the actuator system may comprise any number of motors, couplings, and heddle strings or wires. For instance, the actuator system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 motors, or a number of motors that is within a range defined by any two of the preceding values. The actuator system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 couplings, or a number of couplings that is within a range defined by any two of the preceding values. The actuator system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 heddle strings or wires, or a number of heddle strings or wires that is within a range defined by any two of the preceding values.

Figure 4B:
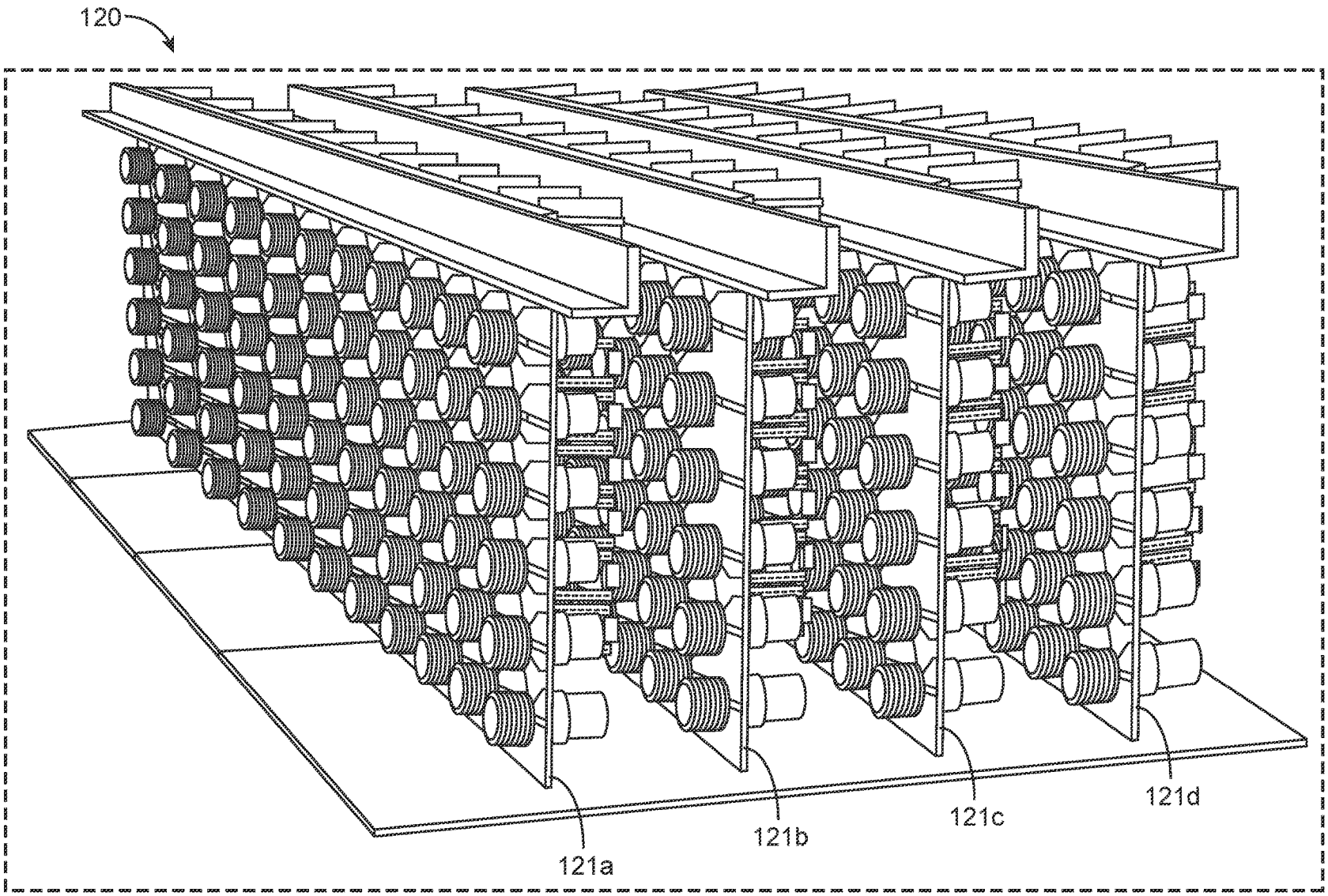
FIG. 4B shows a modular actuator system to be used in combination with a loom, in accordance with some embodiments.

The actuator system may comprise any number of actuator modules, as described herein (for instance, with respect to FIG. 4B).

The actuator system described with respect to FIG. 4A may be optionally combined with any one or more systems described herein or used to implement any one or more methods described herein.

FIG. 4B shows a modular actuator system 120 to be used in combination with a loom. The actuator system may be used in combination with the loom 100 disclosed herein. Alternatively or in combination, the actuator system may be used with any other loom that is not disclosed herein. The actuator system may comprise a plurality of electronic actuation modules. The electronic actuation modules may be operably coupled to one another. One or more of the modules may be independently replaceable without affecting operation of the remaining modules or without requiring disassembly of one or more of the remaining modules. One or more of the modules may be configured to be replaceable prior to or during an operation of the loom. Each module may be similar to module 121 as described herein (for instance, with respect to FIG. 4A). One or more electronic controllers described herein (for instance, with respect to FIG. 4A) may be positioned in proximity to the one or more actuation modules. The electronic controllers may be positioned above, below, in front of, or behind the one or more actuation modules. The electronic controllers may be located within a distance no greater than a height of the loom from the one or more actuation modules. The electronic controllers may be located within a distance no greater than 10 m, no greater than 9 m, no greater than 8 m, no greater than 7 m, no greater than 6 m, no greater than 5 m, no greater than 4 m, no greater than 3 m, no greater than 2 m, or no greater than 1 m from the one or more actuation modules, or within a distance from the one or more actuation modules that is within a range defined by any two of the preceding values. The electronic controllers may be detachably coupled to the one or more actuation modules. Alternatively or in combination, the electronic controllers may be affixed to the one or more actuation modules.

To facilitate ease of module replacement, each of the modules may be releasably coupled to and detached from the actuator system or the loom, such as via a quick release mechanism. The quick release coupling mechanism may enable a user to rapidly mechanically and electrically couple (attach) and/or decouple (remove) each module from the actuator system or the loom with a short sequence of simple motions (such as sliding motions; rotating or twisting motions; depressing a button, switch, or plunger, etc.). A quick release coupling mechanism may require no more than one, two, three, or four user motions to perform a coupling and/or decoupling action. The quick release coupling mechanism may allow one or more modules to be coupled or decoupled manually by a user without the use of tools. The arrangement of the modules in the actuator system (or arrangement with respect to the loom) may also permit a user easy access to the modules. This can be useful, for example when a module in the actuator system needs to be repaired or replaced. In contrast, conventional actuation systems used in looms generally have a large number of actuators and controllers mechanically and electrically coupled together in a serial manner or intricate fashion, which makes it cumbersome for a user to access and replace or repair individual components.

As shown in FIG. 4B, the modular actuator system may comprise first, second, third, and fourth actuator modules 121*a*, 121*b*, 121*c*, and 121*d*, respectively. Each of the first, second, third, and fourth actuator modules may be similar to actuator module 121 described herein (for instance, with respect to FIG. 4A). Each of the modules may be independently replaceable without affecting operation of the remaining modules or without requiring disassembly of one or more of the remaining modules, as described herein.

Though depicted as comprising 4 actuator modules, the modular actuator system may comprise any number of actuator modules (which may comprise any number of motors and couplings, as described herein). For instance, the modular actuator system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 actuator modules, or a number of actuator modules that is within a range defined by any two of the preceding values.

The actuator described with respect to FIG. 4B may be optionally combined with any one or more systems described herein or used to implement any one or more methods described herein.

FIG. 5A shows a heddle system 130 to be used in combination with a loom. The heddle system may be used in combination with the loom 100 disclosed herein. Alternatively or in combination, the heddle system may be used with any other loom that is not disclosed herein. The heddle system may comprise a plurality of heddles. Each heddle may be individually controllable and configured to move continuously between a plurality of positions along one or more axes, such as one or more axes of a heddle plane of the loom. Each heddle may be configured to individually control a position of a warp string. For instance, one or more warp strings may be passed through one or more heddles, allowing the warp strings to be moved between a plurality of positions due to the movement of the heddles. Each heddle may control the movement of at least 1, at least 2, at least 3, at least 4, at least 5, at least 6, at least 7, at least 8, at least 9, or at least 10 warp strings. Individual movement of each heddle between the plurality of positions may define a curved, curvilinear, or non-linear profile of warp string along the heddle plane of the loom. The curved, curvilinear, or non-linear profile of warp strings may enable 3D variation in local geometry of a woven material produced by the loom, as described herein (for instance, with respect to FIG. 1A). The curved, curvilinear, or non-linear profile may have a symmetrical shape. The curved, curvilinear, or non-linear profile may have a non-symmetrical or irregular shaped. For instance, the curved, curvilinear, or non-linear profile may have the shape of a circle, a semi-circle, or any portion of a circle, an oval, a half of an oval, or any portion of an oval, a sinusoid or any portion of a sinusoid, or any other symmetrical, non-symmetrical, regular, or irregular shape. The woven material comprising the 3D variation in local geometry may be produced by a process of passing a weft string under or above the curved, curvilinear, or non-linear profile of warp strings and beating the weft string into a tight interwoven mesh with the plurality of warp strings. Such a process may be iterated as necessary to produce the woven material, as described herein. The process may comprise any number of iterations. For instance, the process may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 iterations of the process, or a number of iterations of the process that is within a range defined by any two of the preceding values. The 3D woven material may comprise surfaces having a variety of shapes, such as a curved, curvilinear, or non-linear shape, spherical shape, hemispherical shape, square shape, circular shape, cuboid shape, trapezoidal shape, disc shape, etc.

As shown in FIG. 5A, the heddle system may comprise first, second, third, fourth, fifth, and sixth heddles 131*a*, 131*b*, 131*c*, 131*d*, 131*e*, and 131*f*, respectively. Each of the first, second, third, fourth, fifth, and sixth heddles may be moved to any of a plurality of positions.

Though depicted as comprising 6 heddles, the heddle system may comprise any number of heddles. For instance, the heddle system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 heddles, or a number of heddles that is within a range defined by any two of the preceding values.

The heddle system described with respect to FIG. 5A may be optionally combined with any one or more systems described herein or used to implement any one or more methods described herein.

Figure 5B:
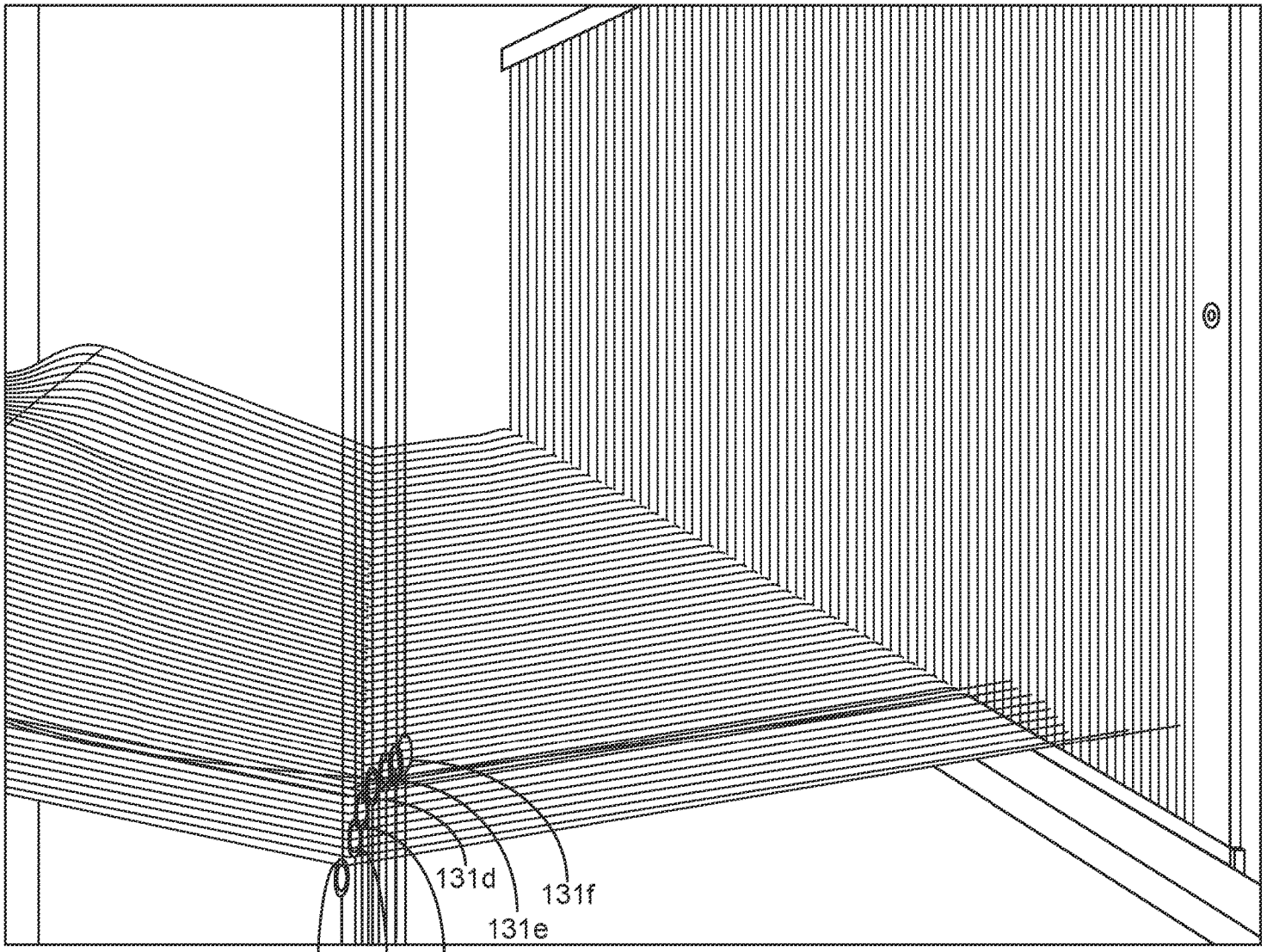
FIG. 5B shows a heddle system to be used in combination with a loom in the process of weaving a seamless woven material that is variable in each of its 3 dimensions, in accordance with some embodiments.

FIG. 5B shows a heddle system 130 to be used in combination with a loom for weaving a seamless woven material that is variable in each of its 3 dimensions. The heddle system may comprise first, second, third, fourth, fifth, and sixth heddles 131*a*, 131*b*, 131*c*, 131*d*, 131*e*, and 131*f*, respectively, as described herein (for instance, with respect to FIG. 5A). The first, second, third, fourth, fifth, and sixth heddles may have first, second, third, fourth, fifth, and sixth warp strings 141*a*, 141*b*, 141*c*, 141*d*, 141*e*, and 141*f*, respectively, passed therethrough. The warp strings may be any warp strings described herein (for instance, with respect to FIG. 3A). As shown in FIG. 5B, the first, second, third, fourth, fifth, and sixth heddles may raise or lower the first, second, third, fourth, fifth, and sixth warp strings to different positions along a heddle plane, allowing the formation of the curved, curvilinear, or non-linear profiles described herein (for instance, with respect to FIG. 5A).

Though depicted as comprising 6 heddles and 6 individually raised or lowered warp strings, the heddle system may comprise any number of heddles and any number of individually raised or lowered warp strings. For instance, the heddle system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 heddles, or a number of heddles that is within a range defined by any two of the preceding values. The heddle system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 individually raised or lowered warp strings, or a number of individually raised or lowered warp strings that is within a range defined by any two of the preceding values.

The heddle system described with respect to FIG. 5B may be optionally combined with any one or more systems described herein or used to implement any one or more methods described herein.

Though depicted as being arranged (for instance, by actuators described herein) to form 2D profiles within a 2D heddle plane in FIGS. 5A and 5B, the heddles of the heddle system may be arranged to form non-2D configurations. The heddles of the heddle system may be arranged to form non-2D configurations across different lines, planes, shapes, sizes, areas, or volumes. The configurations may be regular. For instance, the configurations may have an ordered pattern. The configurations may be irregular. For instance, the configurations may have an amorphous shape. The configurations may comprise arranging the heddles on two or more lines or planes. The lines or planes may or may not intersect with one another. The lines or planes may intersect with one another at different angles, such as acute, orthogonal, or oblique angles. The heddles may be arranged on different lines in a radial configuration, such that the heddles extend out from a same point in space or from a plurality of points in space.

Figure 6A:
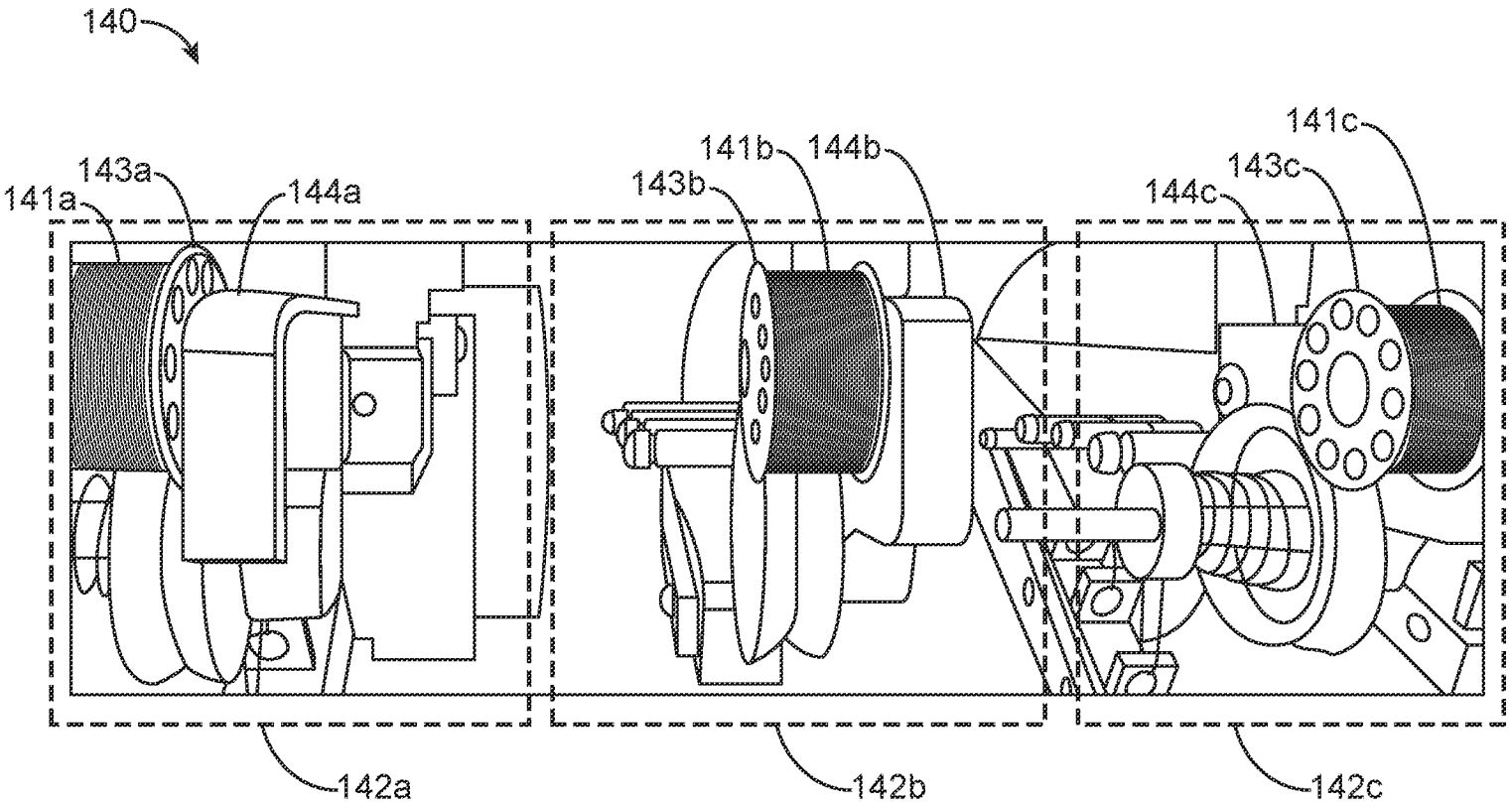
FIG. 6A shows a first view of a warp tension system to be used in combination with a loom, in accordance with some embodiments.

FIG. 6A shows a first view of a warp tension system 140 to be used in combination with a loom. The warp tension system may be used in combination with the loom 100 disclosed herein. Alternatively or in combination, the warp tension system may be used with any other loom that is not disclosed herein. The warp tension system may comprise a plurality of warp tensioners. Each warp tensioner may be individually controllable. Each warp tensioner may be individually controllable in a passive manner. For instance, each warp tensioner may be individually controller using mechanical controllers such as springs. Each warp tensioner may be individually controllable in an active manner. For instance, each warp tensioner may be individually controllable using an actuator to control tension by feeding from the bobbin. Each warp tensioner may be configured to individually control a warp string. For instance, one or more warp strings may be coupled to one or more warp tensioners, allowing one or more warp strings to be advanced by the warp tensioners as a woven material is produced. Each warp tensioner may be coupled to a bobbin. The bobbin may be a mechanical system. The bobbin may be configured to carry a warp string. For example, the bobbin may comprise one or more pulleys for drawing and regulating warp string from a source supply (such as a spool around which one or more warp strings are wound). Each warp tensioner may comprise a mount to which the bobbin or spool is coupled. Each warp tensioner may control the movement of at least 1, at least 2, at least 3, at least 4, at least 5, at least 6, at least 7, at least 8, at least 9, or at least 10 warp strings. Each warp tensioner may be configured to provide or control a tension on one or more warp strings. The warp tensioners may be configured to provide a fixed or constant tension. Alternatively or in combination, the warp tensioners may be configured to provide an adjustable tension. The warp tensioners may be configured to provide a tension that is adjusted based on a measured tension on one or more warp strings. The tension of the warp strings may be maintained or controlled during the weaving process as the heddles are individually raised or lowered along a longitudinal axis of the heddle plane to form complex 3D woven materials. Adequate string or line tensioning may lead to improved quality and reliability of the 3D woven materials. Maintaining the tension may be important, for example, in the weaving of certain high stiffness fibers.

For instance, as shown in FIG. 6A, the warp tension system may comprise first, second, and third warp tensioners 142*a*, 142*b*, and 142*c*, respectively. The first, second, and third warp tensioners may comprise first, second, and third bobbins 143*a*, 143*b*, and 143*c*, respectively. The first, second, and third warp tensioners may comprise first, second, and third mounts 144*a*, 144*b*, and 144*c*, respectively, coupled to the first, second, and third bobbins, respectively. First, second, and third warp strings 141*a*, 141*b*, and 141*c* may be wound around the first, second, and third bobbins, respectively.

Though depicted as comprising 3 warp tensioners, 3 bobbins, 3 mounts, and 3 warp strings, the warp tension system may comprise any number of warp tensioners, bobbins, mounts, and warp strings. For instance, the warp tension system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 warp tensioners, or a number of warp tensioners that is within a range defined by any two of the preceding values. The warp tension system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 bobbins, or a number of bobbins that is within a range defined by any two of the preceding values. The warp tension system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 mounts, or a number of mounts that is within a range defined by any two of the preceding values. The warp tension system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 warp strings, or a number of warp strings that is within a range defined by any two of the preceding values.

The warp tension system described with respect to FIG. 6A may be optionally combined with any one or more systems described herein or used to implement any one or more methods described herein.

Figure 6B:
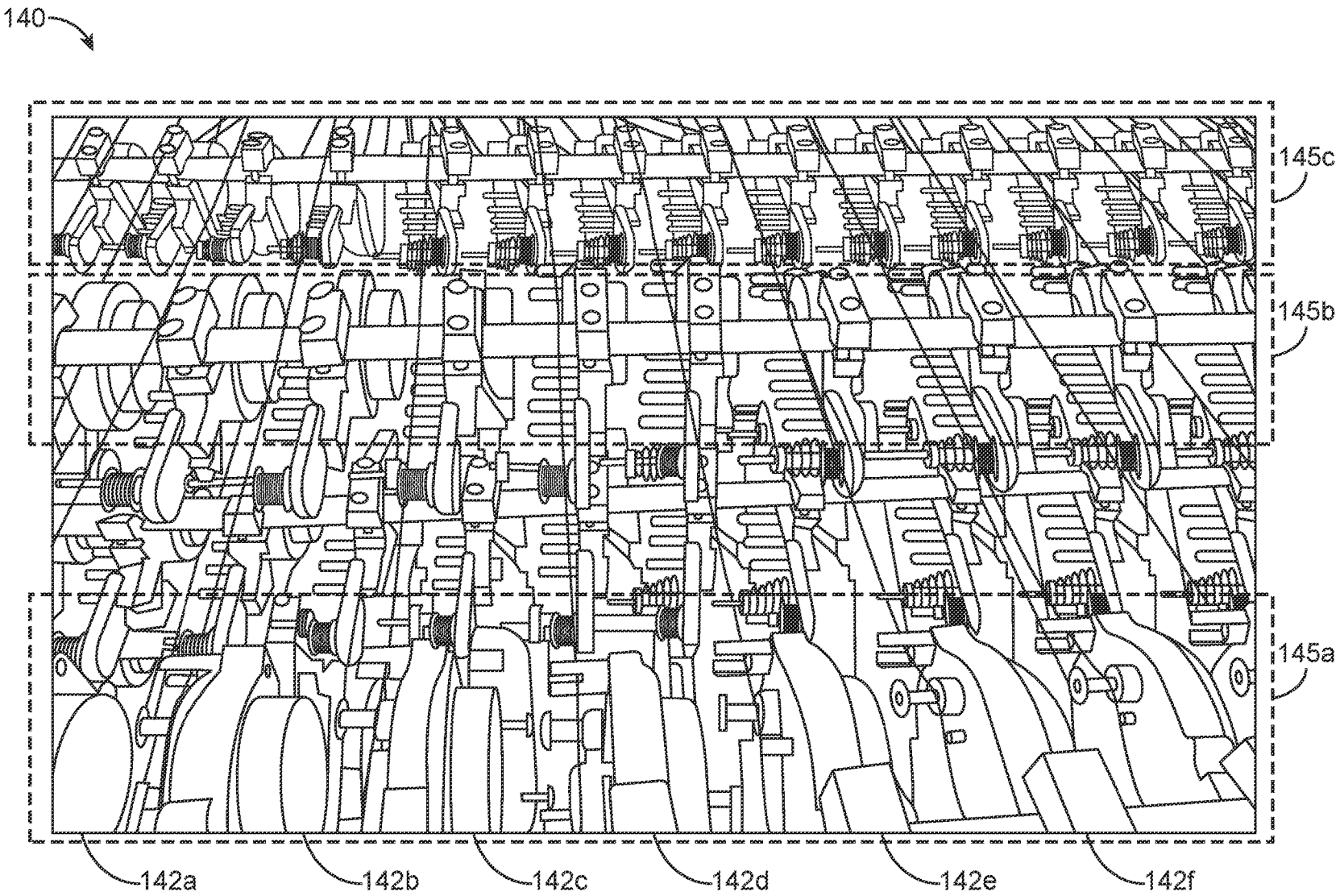
FIG. 6B shows a second view of a warp tension system to be used in combination with a loom in the process of weaving a seamless woven material that is variable in each of its 3 dimensions, in accordance with some embodiments.

FIG. 6B shows a second view of a warp tension system 140 to be used in combination with a loom in the process of weaving a seamless woven material that is variable in each of its 3 dimensions. The warp tension system may be modular in configuration. The warp tension system may comprise one or more warp tension modules. Each warp tension module may comprise one or more warp tensioners. The warp tensioners may be any warp tensioners described herein (for instance, with respect to FIG. 6A). The warp tension modules may be configured to be individually removable before or during an operation of a loom with which the warp tension modules are associated.

For instance, as shown in FIG. 6B, the warp tension system may comprise first, second, and third warp tension modules 145*a*, 145*b*, and 145*c*, respectively. The first warp tension module may comprise first, second, third, fourth, fifth, and sixth warp tensioners 142*a*, 142*b*, 142*c*, 142*d*, 142*e*, and 142*f*, respectively. Each of the first, second, third, fourth, fifth, and sixth warp tensioners may be similar to warp tensioner 142 described herein. Similarly, the second and third warp tension modules may each comprise first, second, third, fourth, fifth, and sixth warp tensioners, each of which may be similar to warp tensioner 142 described herein. Warp tensioners associated with the second and third warp tension modules are not shown in FIG. 6B.

Though depicted as comprising 3 warp tension modules and 6 warp tensioners per module, the warp tension system may comprise any number of warp tension modules, any of which may comprise any number of warp tensioners. For instance, the warp tension system may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 warp tension modules, or a number of warp tension modules that is within a range defined by any two of the preceding values. Any of the warp tension modules may comprise at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 warp tensioners, or a number of warp tensioners that is within a range defined by any two of the preceding values.

The warp tension system described with respect to FIG. 6B may be optionally combined with any one or more systems described herein or used to implement any one or more methods described herein.

Figure 6C:
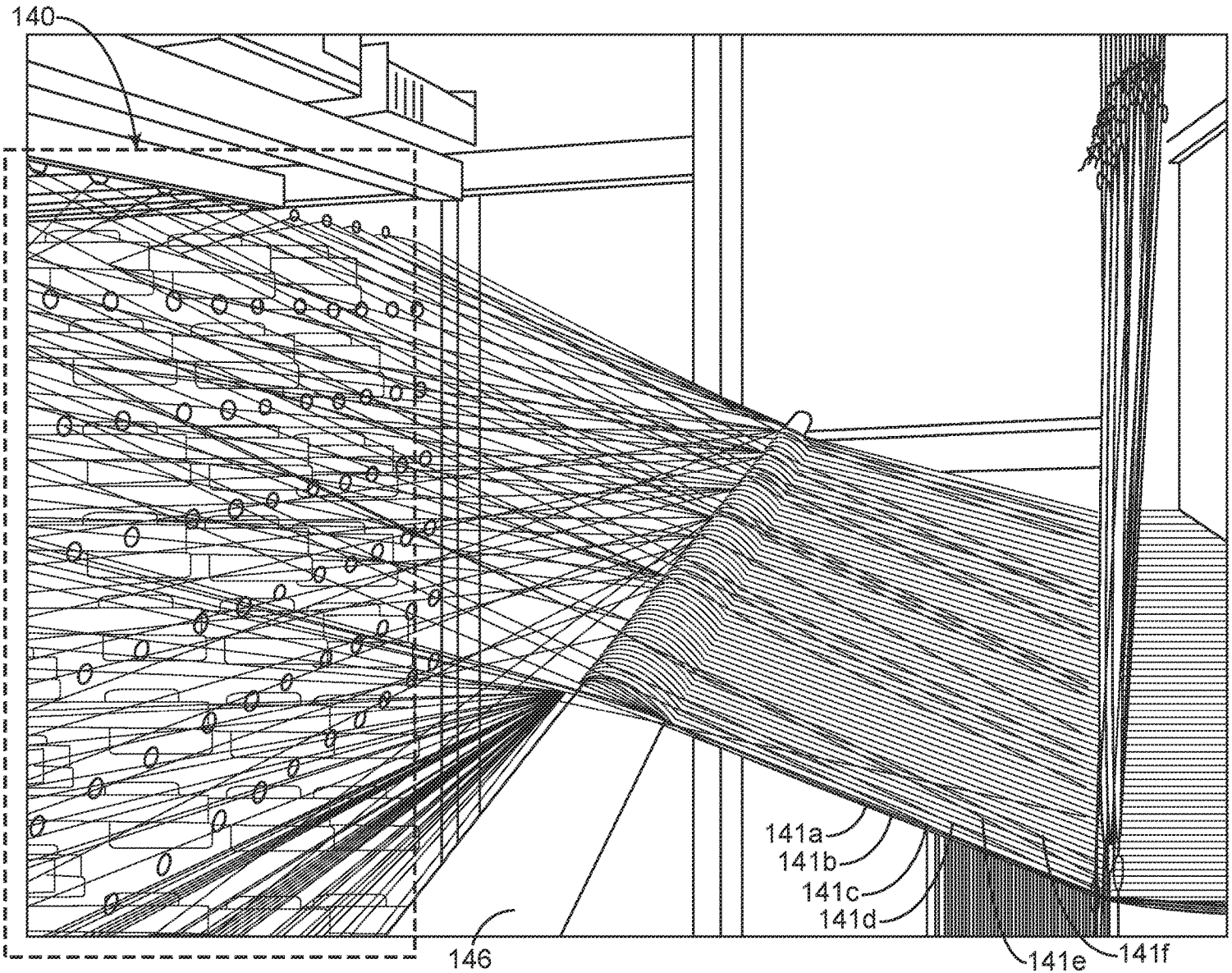
FIG. 6C shows a third view of a warp tension system to be used in combination with a loom in the process of weaving a seamless woven material that is variable in each of its 3 dimensions, in accordance with some embodiments.

FIG. 6C shows a third view of a warp tension system 140 to be used in combination with a loom in the process of weaving a seamless woven material that is variable in each of its 3 dimensions. The warp tension system may comprise an alignment mechanism 146 configured to provide a tension on a plurality of warp strings in combination with the plurality of warp tensioners and to control a physical arrangement of the warp strings. The alignment mechanism may comprise one or more rollers. The alignment mechanism may be configured to align the warp strings along a longitudinal axis prior to entry of the warp strings into different individual positions on the heddle plane.

For instance, as shown in FIG. 6C, the warp tension system may be used to control movement of a plurality of warp strings, such as first, second, third, fourth, fifth, and sixth warp strings 141*a*, 141*b*, 141*c*, 141*d*, 141*e*, and 141*f* described herein, respectively. Though depicted as comprising 6 warp strings, the warp tension system may be used to control movement of any number of warp strings. For instance, the warp tension system may be used to control movement of at least 1, at least 2, at least 3, at least 4, at least 5, at least 6, at least 7, at least 8, at least 9, at least 10, at least 20, at least 30, at least 40, at least 50, at least 60, at least 70, at least 80, at least 90, at least 100, at least 200, at least 300, at least 400, at least 500, at least 600, at least 700, at least 800, at least 900, at least 1,000, at least 2,000, at least 3,000, at least 4,000, at least 5,000, at least 6,000, at least 7,000, at least 8,000, at least 9,000, or at least 10,000 warp strings, or a number of warp strings that is within a range defined by any two of the preceding values.

The warp tension system described with respect to FIG. 6C may be optionally combined with any one or more systems described herein or used to implement any one or more methods described herein.

Figure 7:
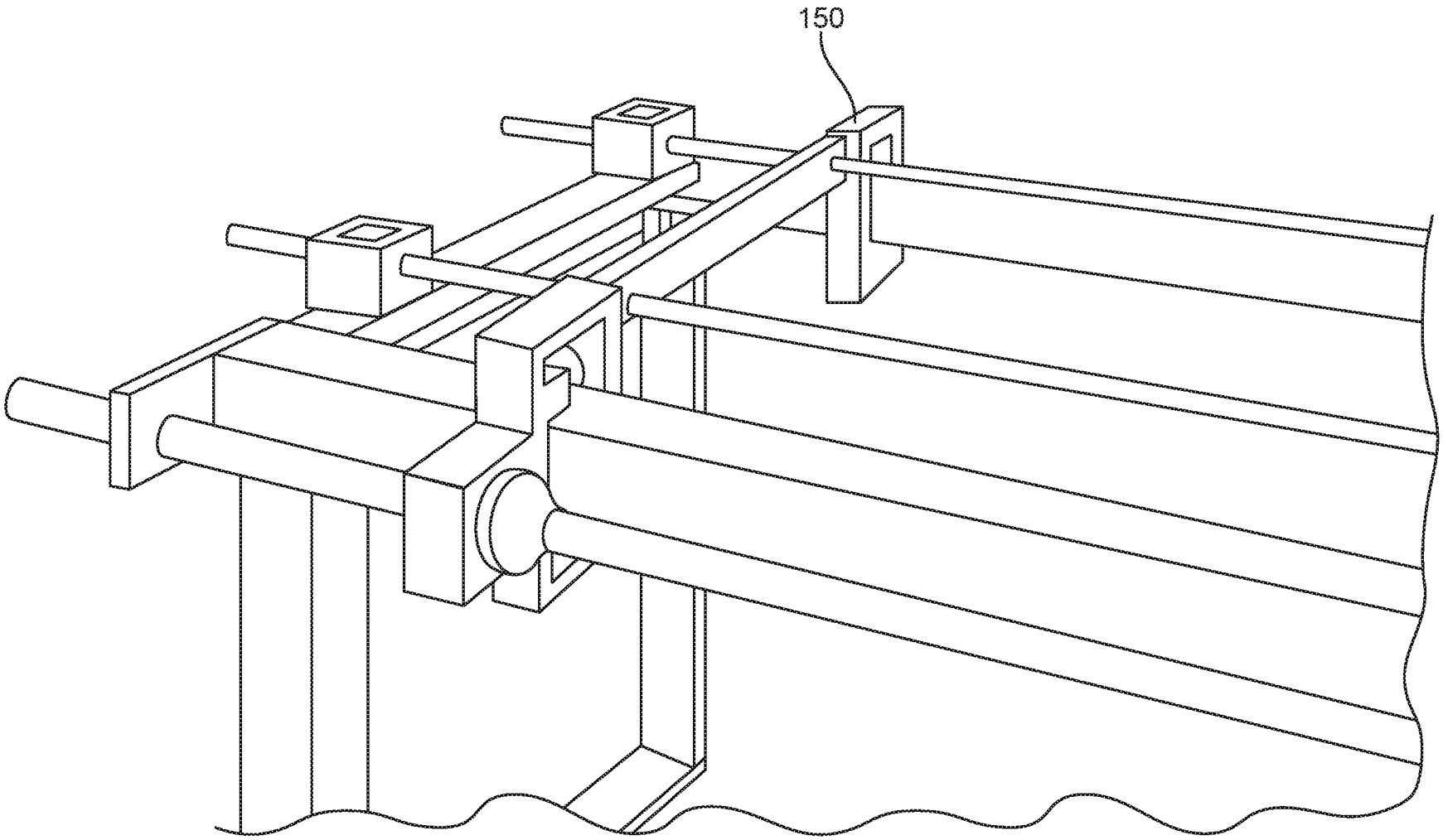
FIG. 7 shows a fabric advancer to be used in combination with a loom, in accordance with some embodiments.

FIG. 7 shows a fabric advancer 150 to be used in combination with a loom. The fabric advancer may be configured to provide a tension to a plurality of warp strings in combination with the warp tension system.

The fabric advancer described with respect to FIG. 7 may be optionally combined with any one or more systems described herein or used to implement any one or more methods described herein.

Figure 8:
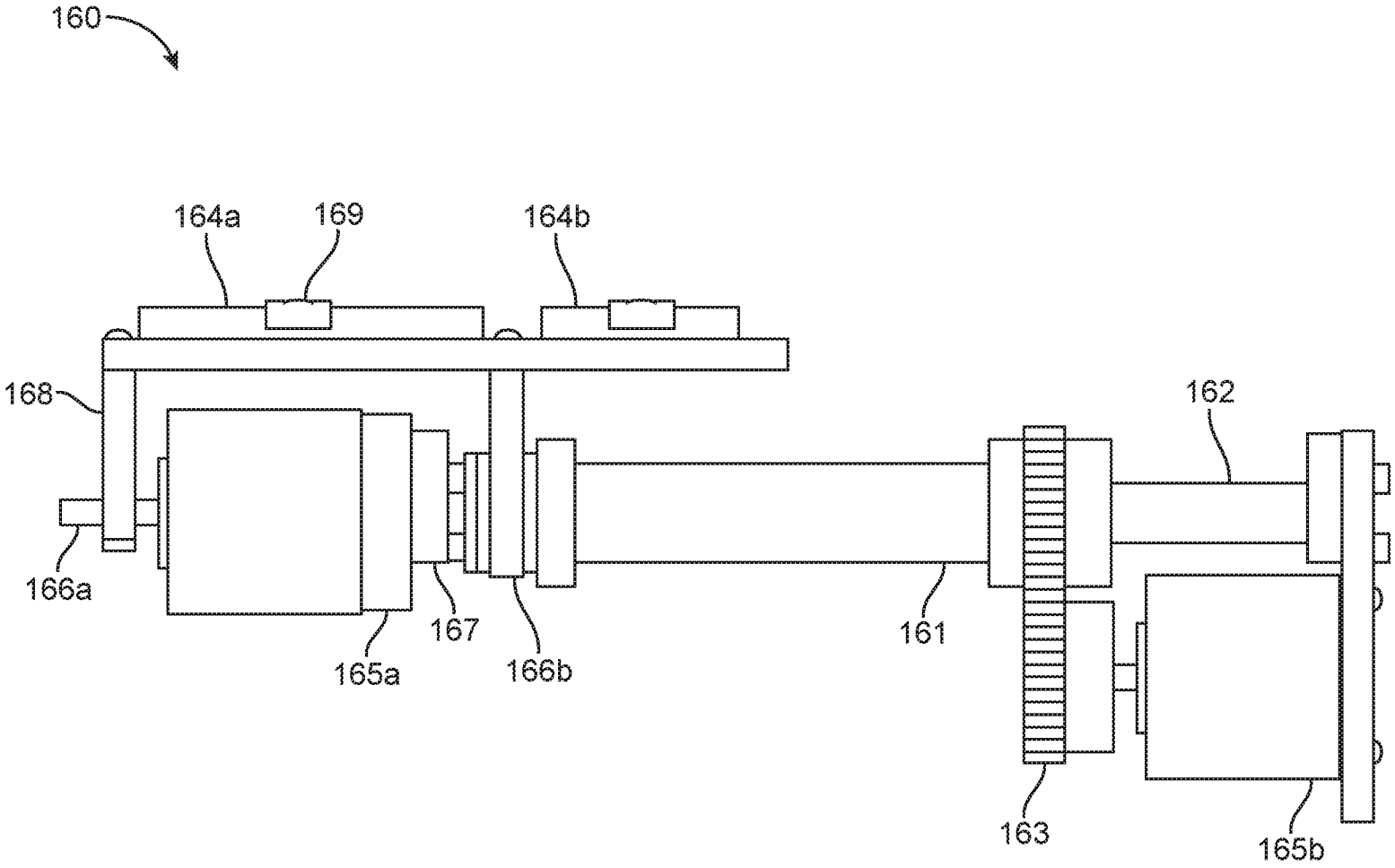
FIG. 8 shows a weft system to be used in combination with a loom, in accordance with some embodiments.

FIG. 8 shows a weft system 160 to be used in combination with a loom. The weft system may be used in combination with the loom 100 disclosed herein. Alternatively or in combination, the weft system may be used with any other loom that is not disclosed herein. The weft system may comprise a weft yarn bobbin 161. The weft yarn bobbin may hold weft yarn to be used in the weaving systems and methods described herein. The weft yarn bobbin may be rotated around an axle 162 by a gear 163. The gear may comprise a metallic or non-metallic material. The gear may comprise a metallic alloy. The gear may comprise a plastic. The gear may comprise a thermoplastic. The gear may comprise a thermosetting plastic. The gear may comprise a polymeric material. The gear may comprise a fluoropolymer. The gear may comprise polytetrafluoroethylene (PTFE). The gear may be driven by an actuator, which may feed weft yarn through first and second weft tubes 164*a* and 164*b*, respectively. The first and second weft tubes may be rotated by first and second motors 165*a* and 165*b*, respectively. This may cause a loop of weft to be grabbed by a weft puller (not shown in FIG. 8). The system may further comprise a first rotating weft arm 166*a*, a second rotating weft arm 166*b*, a clamping hub 167, a rotating weft plate 168, and a guide clamp 169. The first and second rotating weft arms, clamping hub, rotating weft plate, and guide clamp may enable rotation and guide of a weft string.

The weft system described with respect to FIG. 8 may be optionally combined with any one or more systems described herein or used to implement any one or more methods described herein.

Figure 9:
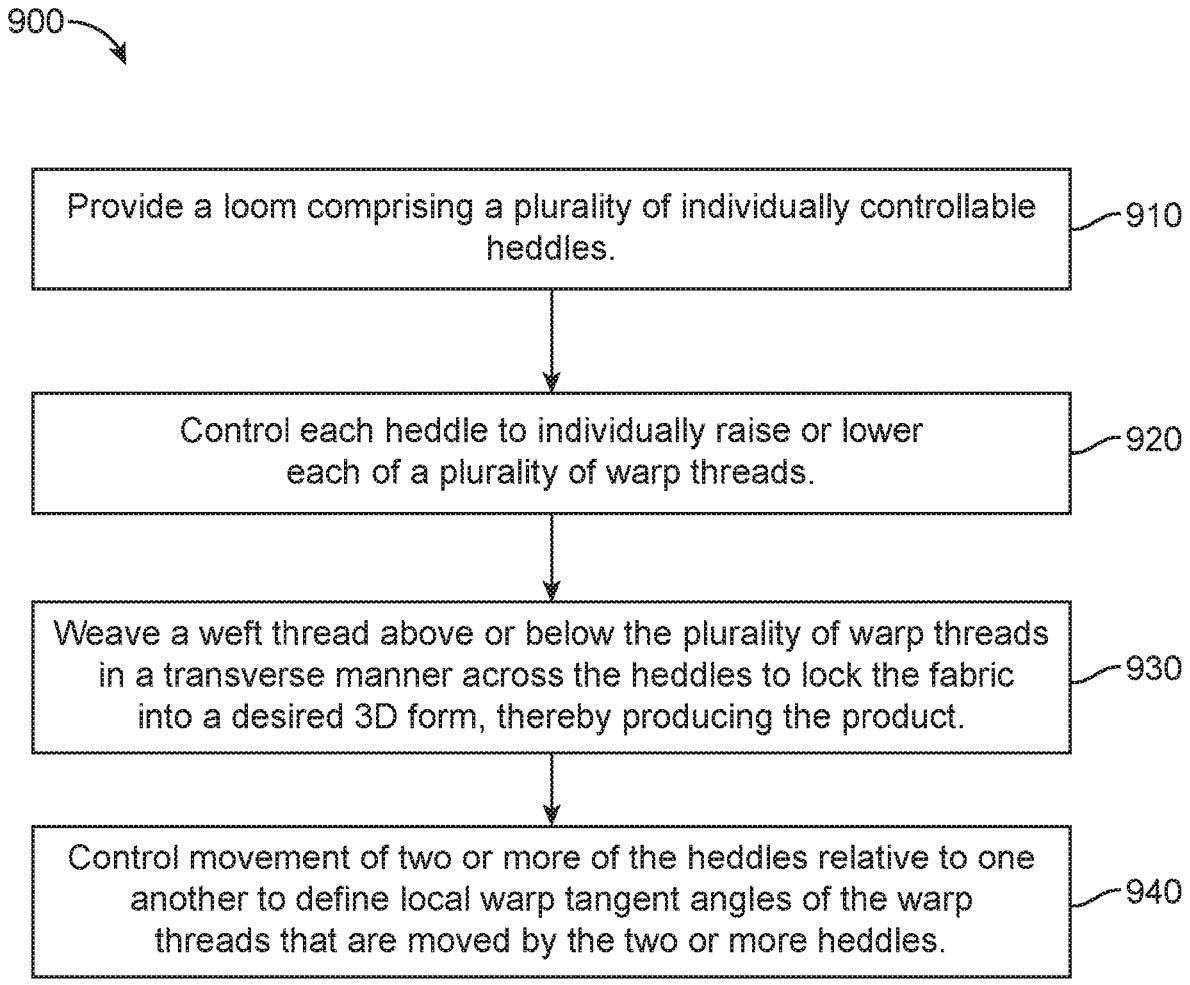
FIG. 9 shows a flowchart for a method of producing a product that is variable in each of its 3 dimensions, in accordance with some embodiments.

FIG. 9 shows a flowchart for a method 900 of producing a product that is variable in each of its 3 dimensions. In a first operation 910, the method may comprise providing a loom comprising a plurality of individually controllable heddles. The loom may be similar to any loom described herein. In a second operation 920, the method may comprise controlling each heddle to individually raise or lower each of a plurality of warp threads, as described herein. In a third operation 930, the method may comprise weaving a weft thread above, below, or through the plurality of warp threads in a transverse manner across the heddles to lock the fabric into a desired 3D form, thereby producing the product, as described herein. In a fourth operation 940, the method may comprise controlling movement or two or more of the heddles relative to one another to define local warp tangents angles of the warp threads that are moved by the two or more heddles, as described herein (for instance, with respect to FIG. 10).

Many variations, alterations, and adaptations based on the method 900 provided herein are possible. For example, the order of the operations of the method 900 may be changed, some of the operations removed, some of the operations duplicated, and additional operations added as appropriate. Some of the operations may be performed in succession. Some of the operations may be performed in parallel. Some of the operations may be performed once. Some of the operations may be performed more than once. Some of the operations may comprise sub-operations. Some of the operations may be automated and some of the operations may be manual.

The method described with respect to FIG. 9 may be optionally combined with any one or more methods described herein or implemented using any one or more systems described herein.

Figure 10:
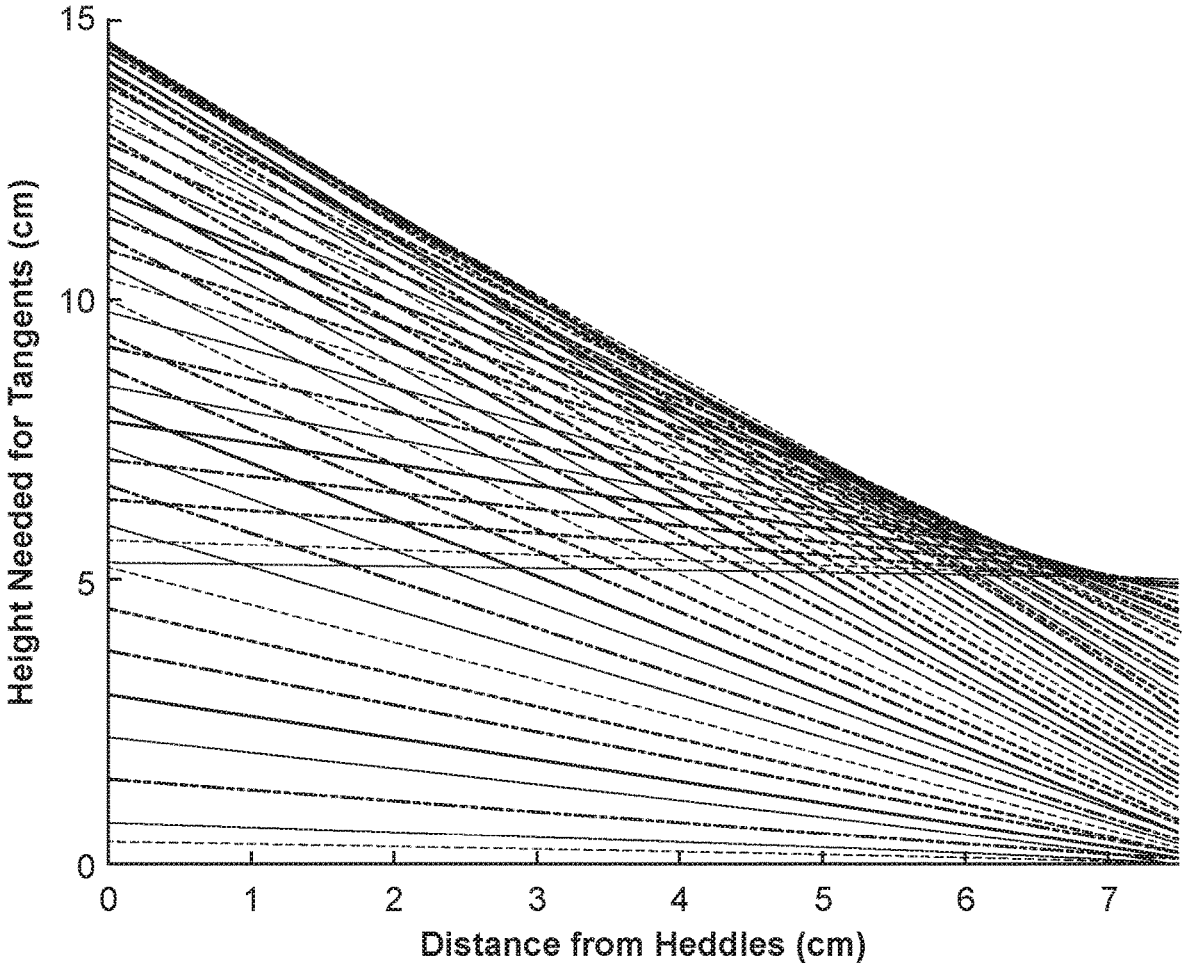
FIG. 10 shows an exemplary graphic method of determining heddle tangent angles for different altitudes of fabric topography, in accordance with some embodiments.

FIG. 10 shows an exemplary graphical method of determining heddle tangent angles for different altitudes of fabric topography. Depicted are a series of functions plotting a distance of a woven fabric from the heddle plane for a given point in an exemplary fabric profile.

The method described with respect to FIG. 10 may be optionally combined with any one or more methods described herein or implemented using any one or more systems described herein.

One skilled in the art will understand that different aspects or embodiments of the present disclosure may be combined as necessary or desire to meet different weaving, manufacturing, or material considerations or application or to produce different looms or woven materials.

While preferred embodiments of the present disclosure have been shown and described herein, it will be obvious to those skilled in the art that such embodiments are provided by way of example only. It is not intended that the disclosure be limited by the specific examples provided within the specification. While the present disclosure has been described with reference to the aforementioned specification, the descriptions and illustrations of the embodiments herein are not meant to be construed in a limiting sense. Numerous variations, changes, and substitutions will now occur to those skilled in the art without departing from the disclosure. Furthermore, it shall be understood that all aspects of the disclosure are not limited to the specific depictions, configurations or relative proportions set forth herein which depend upon a variety of conditions and variables. It should be understood that various alternatives to the embodiments of the disclosure described herein may be employed. It is therefore contemplated that the disclosure shall also cover any such alternatives, modifications, variations or equivalents. It is intended that the following claims define the scope of the disclosure and that methods and structures within the scope of these claims and their equivalents be covered thereby.

What is claimed is:

1. An actuator system configured to be used in combination with a loom, comprising:

a. a plurality of motors;

b. a plurality of heddles forming a heddle plane;

c. at least one electronic controller for controlling motion of the plurality of motors to individually effect changes in position of the one or more of the heddles, the at least one electronic controller being configured to output an electrical signal to one motor of the plurality of motors; and d. a plurality of couplings coupled to the plurality of motors, wherein the plurality of couplings are arranged in a configuration that allows the at least one electronic controller to be configured to individually control one or more of the plurality of heddles of the loom continuously between a plurality of positions located along a longitudinal axis in the heddle plane of the loom to individually raise and lower a warp string, the plurality of positions of successive heddles of the plurality of heddles collectively defining a curved, curvilinear, or non-linear profile of warp strings along the heddle plane, wherein a curvature defined by the curved, curvilinear, or non-linear profile of warp strings is imparted into a final woven product profile when a weft string is passed between the warp strings, each of the one or more heddles being configured to engage at least one of the warp strings.

2. The system of claim 1, wherein each motor is mechanically coupled to one coupling.

3. The system of claim 1, wherein each motor is coupled to one heddle of the one or more heddles.

4. The system of claim 1, wherein each coupling reduces an angular velocity imparted to one or more coupled motors, the angular velocity associated with one or more torques due to gravitational force or a spring force imparted on one or more heddles.

5. The system of claim 1, wherein each coupling comprises a gear reduction component and a pulley system.

6. The system of claim 5, wherein the pulley system is threaded or non-threaded.

7. The system of claim 5, wherein the gear reduction component is disposed between a motor and the pulley component.

8. The system of claim 5, wherein the gear reduction component comprises at least two gears of different pitch diameters or different numbers of teeth.

9. The system of claim 5, wherein the gear reduction component reduces a torque-induced turning of a motor.

10. The system of claim 5, wherein the gear reduction component comprises a 10:1, 20:1, 50:1, or 100:1 gear reduction ratio.

11. The system of claim 1, wherein the couplings allow the motors to be actuated in a controlled manner during an operation of the heddles.

12. The system of claim 1, wherein the configuration of the plurality of couplings enables power consumption to be reduced by obviating a need to provide a continuous torque to the one or more heddles during one or more passes of a weft thread across the loom.

13. The system of claim 1, wherein each motor is selected from the group consisting of: brushed direct current (DC) motors, brushless DC motors, servo motors, and stepper motors.

14. The system of claim 13, wherein each motor is configured to move each heddle along one or more axes of the heddle plane of the loom.

15. The system of claim 1, consisting of only one warp shed:

wherein the at least one electronic controller is further configured to output electrical signals to the plurality of motors for controlling motion of the motors to effect changes in position of the one or more of the heddles to pass a weft string into the only one warp shed to form a single layer fabric and thereby impart the curvature to the final woven product profile formed from the single layer fabric.

16. The system of claim 1, wherein the plurality of positions comprises two or more discrete positions along the longitudinal axis of the heddle plane.

17. The system of claim 1, wherein the plurality of positions comprises at least three discrete positions along the longitudinal axis of the heddle plane.

18. The system of claim 16, wherein a distance between two adjacently spaced discrete positions is at least about 0.01 mm, 0.02 mm, 0.05 mm, 0.1 mm, 0.2 mm, 0.5 mm, 1 mm, 2 mm, 5 mm, or 10 mm.

19. The system of claim 16, wherein a distance between two adjacently spaced discrete positions ranges from about 0.01 mm to about 10 mm.

20. The system of claim 1, further comprising a plurality of warp tensioners applying tension along a longitudinal axis of the warp strings, perpendicular to the heddle plane, wherein each of the one or more of the warp strings is coupled to and individually controlled by a respective one of the plurality of warp tensioners.

21. The system of claim 20, wherein each of the plurality of warp tensioners is configured to control a respective warp string individually and continuously.

22. The system of claim 15, wherein the at least one electronic controller is further configured to effect changes in position of the one or more of the heddles to continuously change the curvature of the final woven product profile formed from the single layer fabric.

* * * * *